US011793321B2

(12) United States Patent
Lau et al.

(10) Patent No.: US 11,793,321 B2
(45) Date of Patent: Oct. 24, 2023

(54) BUILT-IN AIR PUMP ASSEMBLY

(71) Applicant: Sun Pleasure Company Limited, Kowloon (HK)

(72) Inventors: Vincent W. S. Lau, Kowloon (HK); Shouguo Long, Kowloon (HK)

(73) Assignee: Sun Pleasure Company Limited

( * ) Notice: Subject to any disclaimer, the term of this patent is extended or adjusted under 35 U.S.C. 154(b) by 33 days.

(21) Appl. No.: 17/572,149

(22) Filed: Jan. 10, 2022

(65) Prior Publication Data

US 2022/0125214 A1 Apr. 28, 2022

Related U.S. Application Data

(63) Continuation-in-part of application No. 17/003,684, filed on Aug. 26, 2020, now Pat. No. 11,317,731, which is a continuation of application No. 16/358,188, filed on Mar. 19, 2019, now abandoned, which is a continuation-in-part of application No. 16/057,355, filed on Aug. 7, 2018, now Pat. No. 10,786,089.

(51) Int. Cl.

| | |
|---|---|
| ***A47C 27/08*** | (2006.01) |
| ***F04D 25/16*** | (2006.01) |
| ***F04D 27/00*** | (2006.01) |
| ***F04D 25/06*** | (2006.01) |
| ***F04D 29/42*** | (2006.01) |
| ***F04D 29/50*** | (2006.01) |

(52) U.S. Cl.

CPC ..... *A47C 27/082* (2013.01); *F04D 25/06* (2013.01); *F04D 25/068* (2013.01); *F04D 25/166* (2013.01); *F04D 27/005* (2013.01); *F04D 29/4213* (2013.01); *F04D 29/503* (2013.01); *F04D 25/16* (2013.01); *F05B 2260/602* (2013.01)

(58) Field of Classification Search

CPC ..... A47C 27/082; F04D 25/06; F04D 25/068; F04D 25/166; F04D 25/16; F04D 27/005; F04D 29/4213; F04D 29/503; F05B 2260/602

See application file for complete search history.

(56) References Cited

U.S. PATENT DOCUMENTS

| | | | | |
|---|---|---|---|---|
| 10,786,089 | B2 * | 9/2020 | Lau | F04D 25/068 |
| 11,317,731 | B2 * | 5/2022 | Lau | F04D 29/403 |
| 11,339,792 | B2 * | 5/2022 | Li | A47C 27/082 |
| 2006/0085918 | A1 * | 4/2006 | Metzger | F04D 25/084 5/713 |
| 2017/0254337 | A1 * | 9/2017 | Lau | F04D 29/284 |

* cited by examiner

*Primary Examiner* — Charles G Freay
(74) *Attorney, Agent, or Firm* — Raymond Sun

(57) ABSTRACT

A pump assembly is provided for use with an inflatable product. The inflatable product has a chamber having an air inlet and an air outlet. The pump assembly has a pump unit that is positioned inside the chamber for inflating and deflating the chamber, the pump unit having at least one motor that is operatively coupled to a first blower and a second blower, with the first blower fluidly coupled to the air inlet and the second blower fluidly coupled to the air outlet. The chamber is inflated by intake of air through the air inlet to the first blower and then into the chamber, and the chamber is deflated by drawing air from the chamber to the second blower and then out of the chamber through the air outlet.

11 Claims, 31 Drawing Sheets

BUILT-IN AIR PUMP ASSEMBLY

BACKGROUND OF THE INVENTION

1. Field of the Invention

The present invention relates to air pumps, and more particularly to a built-in air pump that can be deployed for inflation and deflation of an inflatable product, such as an air mattress.

2. Description of the Prior Art

Inflatable products have become very popular. In particular, inflatable air mattresses have become a very useful item that has found use at homes, camping and other applications. These inflatable air mattresses are typically inflated and deflated by air pumps. Some of these mattresses have been provided with built-in air pumps that can be stored in a socket or space that is provided in the housing of the mattress, and then pulled out and deployed for use in inflating and deflating the mattress.

Many of the existing built-in air pumps suffer from a number of drawbacks. For example, the construction of these built-in air pumps can be complicated which leads to increased cost and reliability issues. In addition, many of the existing pump units have their vents exposed to the environment when the product is either inflated in use or deflated for storage (i.e., when the pump unit is not in use), so that the interior of the pump units can be contaminated by water or dirt.

In addition, many of the existing air pumps in the market have different functions due to the structural transformation of the air duct. These pumps have complicated air passages and many components that must be structurally matched, which often leads to large airflow loss and high air leakage during the inflation process. At the same time, the complicated structure also increases the difficulties and costs of production.

Therefore, there remains a need for more effective built-in air pumps that can be used with inflatable products, such as mattresses, and which avoids the drawbacks of the present pump units.

SUMMARY OF THE DISCLOSURE

In order to accomplish the objects of the present invention, there is provided a pump assembly for use with an inflatable product. The inflatable product has a chamber having an air inlet and an air outlet. The pump assembly has a pump unit that is positioned inside the chamber for inflating and deflating the chamber, the pump unit having at least one motor that is operatively coupled to a first blower and a second blower, with the first blower fluidly coupled to the air inlet and the second blower fluidly coupled to the air outlet. The chamber is inflated by intake of air through the air inlet to the first blower and then into the chamber, and the chamber is deflated by drawing air from the chamber to the second blower and then out of the chamber through the air outlet.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
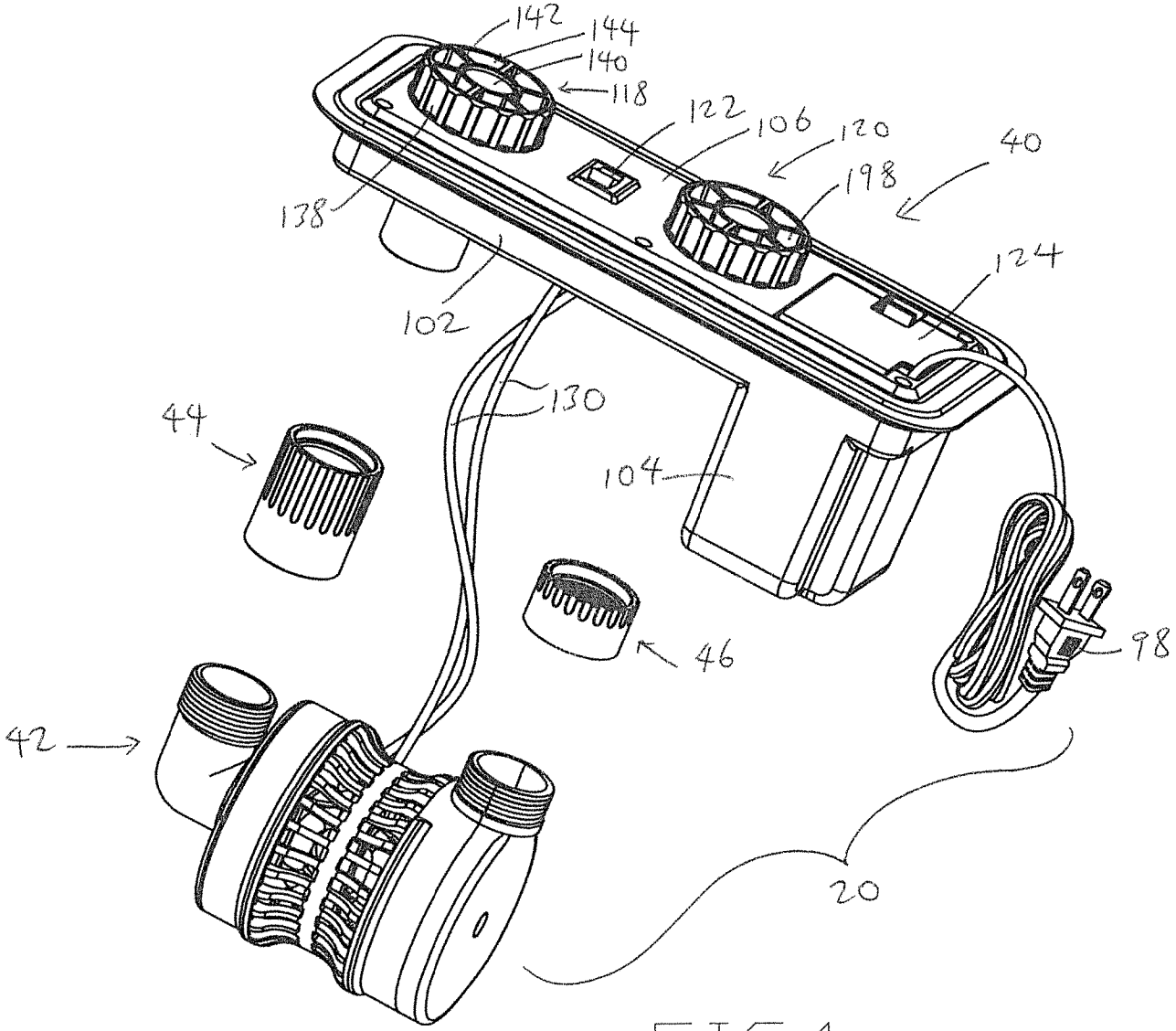
FIG. 1 is an exploded perspective view of the main components of a built-in pump assembly according to one embodiment of the present invention.
Figure 2:
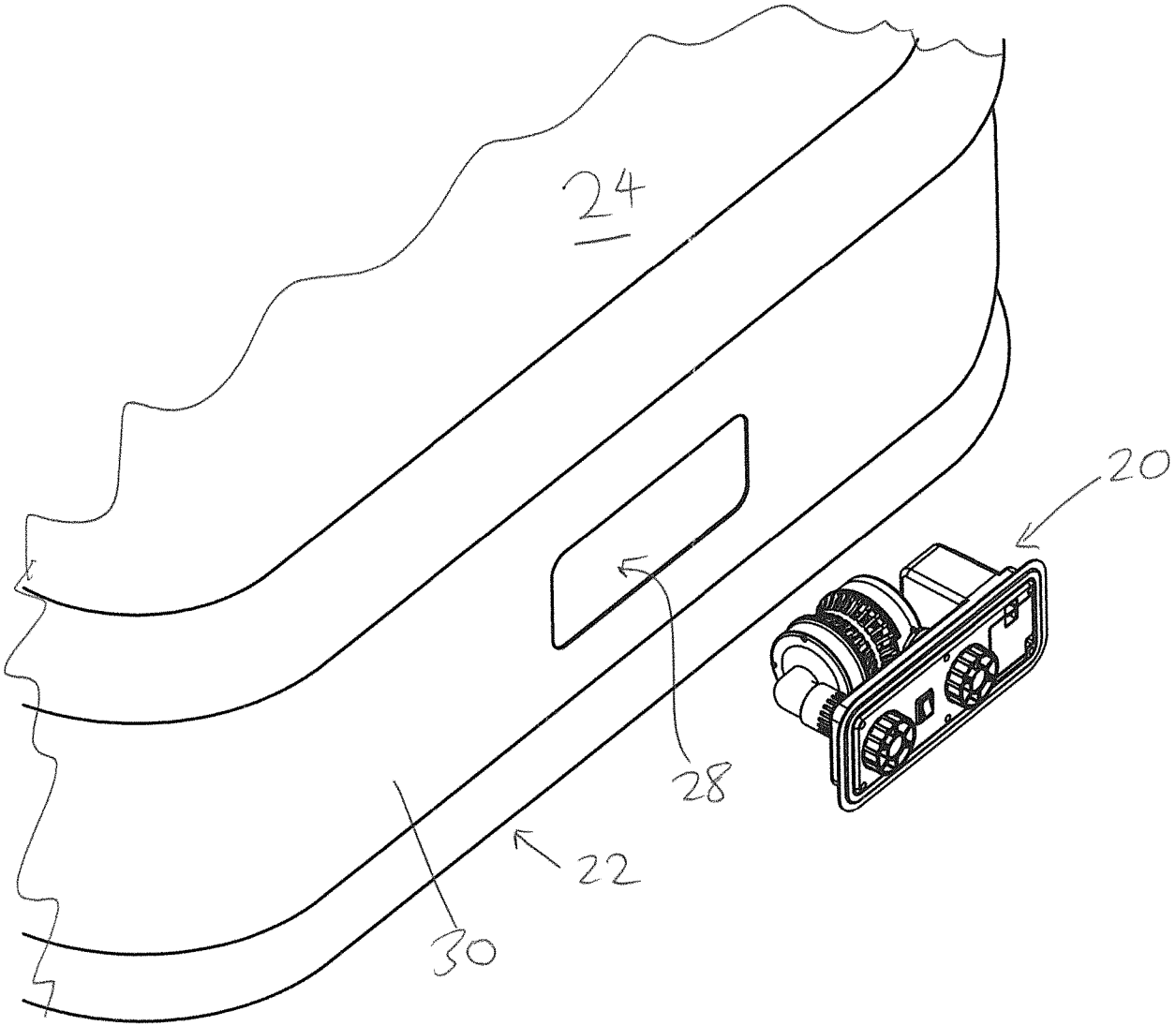
FIG. 2 is a perspective view of an inflatable mattress with the pump assembly of FIG. 1 incorporated therein.
Figure 3A:
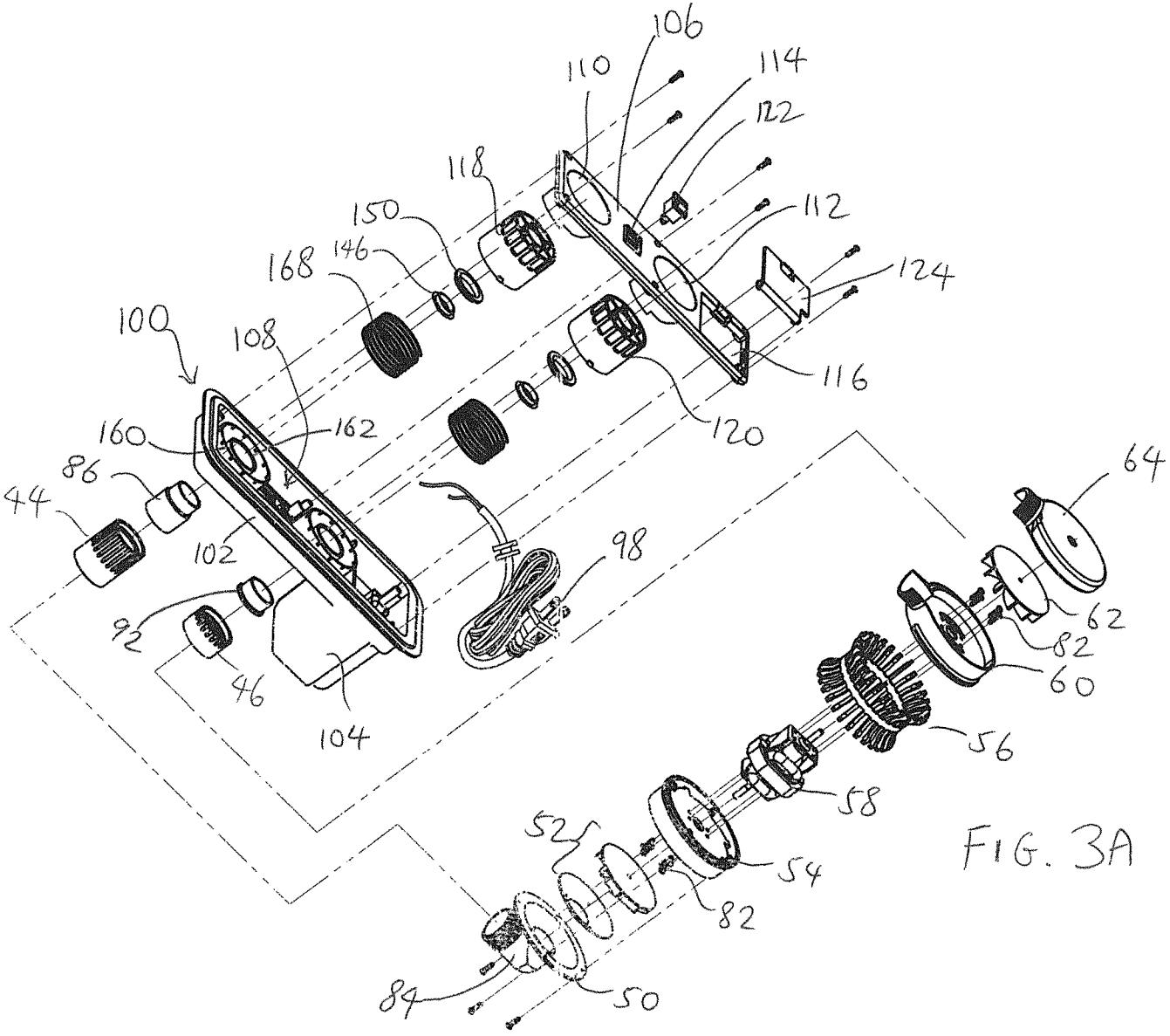
FIG. 3A is an exploded view of the main components of FIG. 1.
Figure 3B:
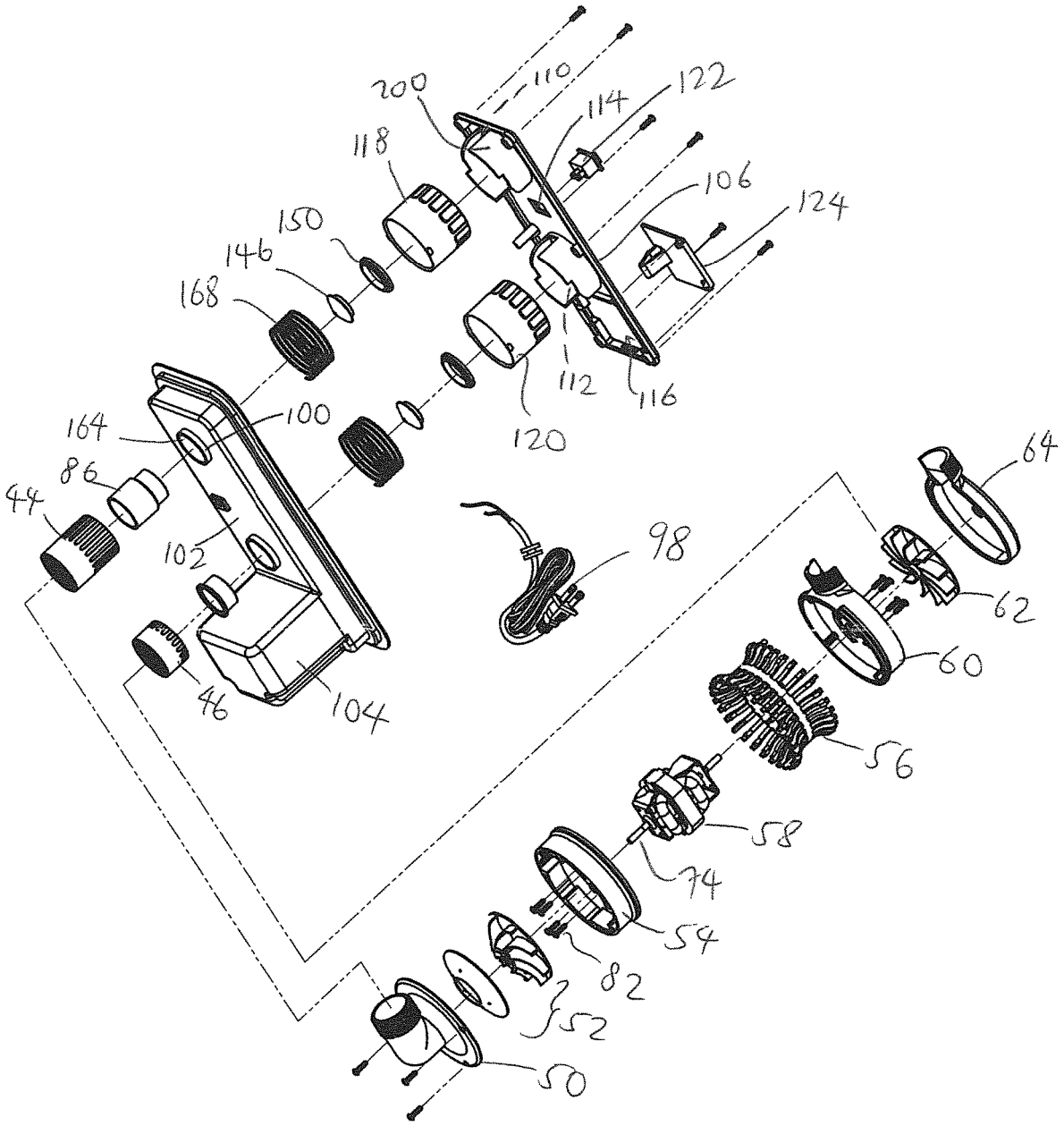
FIG. 3B is another exploded view of the main components of FIG. 1.

Referring to FIG. 2, the pump assembly 20 of the present invention can be built in to the body 24 of an inflatable mattress 22. Specifically, the inflatable mattress 22 can have an inflatable bladder or body 24, and a recessed region 28 provided in a side wall 30 of the body 24. The pump assembly 20 can be secured to the recessed region 28 by high frequency welding.

Referring now to FIGS. 1 and 3-6B, the pump assembly 20 has a control housing assembly 40, a pump unit that is a double-blower assembly 42, and two connection tubes 44 and 46 that function as air ducts. The control housing assembly 40 houses the electronics and switches, air inlets, and air outlets, as explained in greater detail below. The double-blower assembly 42 is provided below the control housing assembly 40 and is separate and spaced-apart from the control housing assembly 40. An intake connection tube 44 couples the air inlet of the control housing assembly 40 with one blower of the double-blower assembly 42, and an exhaust connection tube 46 couples the air outlet of the control housing assembly 40 with the other blower of the double-blower assembly 42.

Double Blower Assembly 42

Figure 6A:
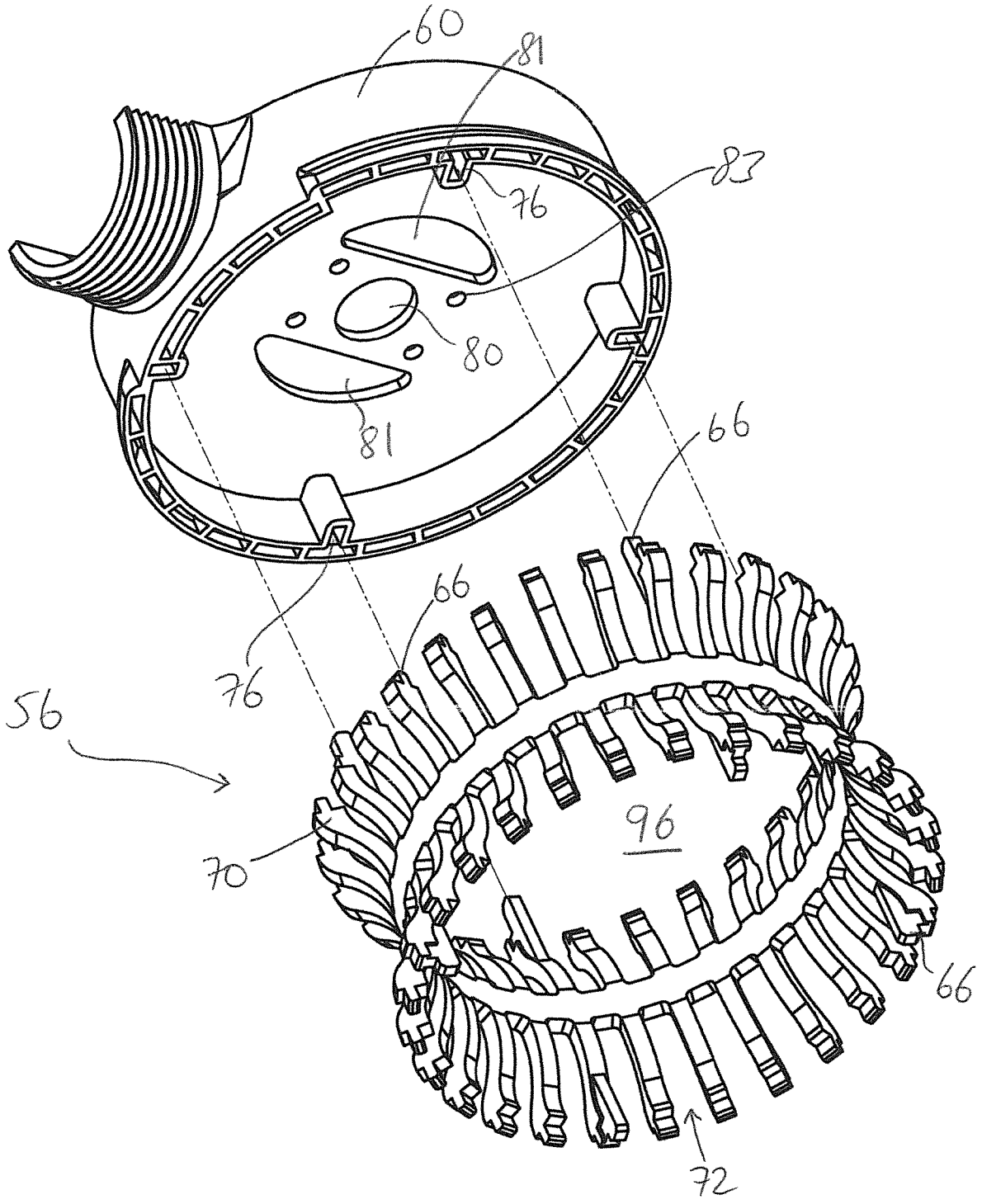
FIG. 6A is an exploded view illustrating the connection of the exhaust motor support and the protective net.
Figure 6B:
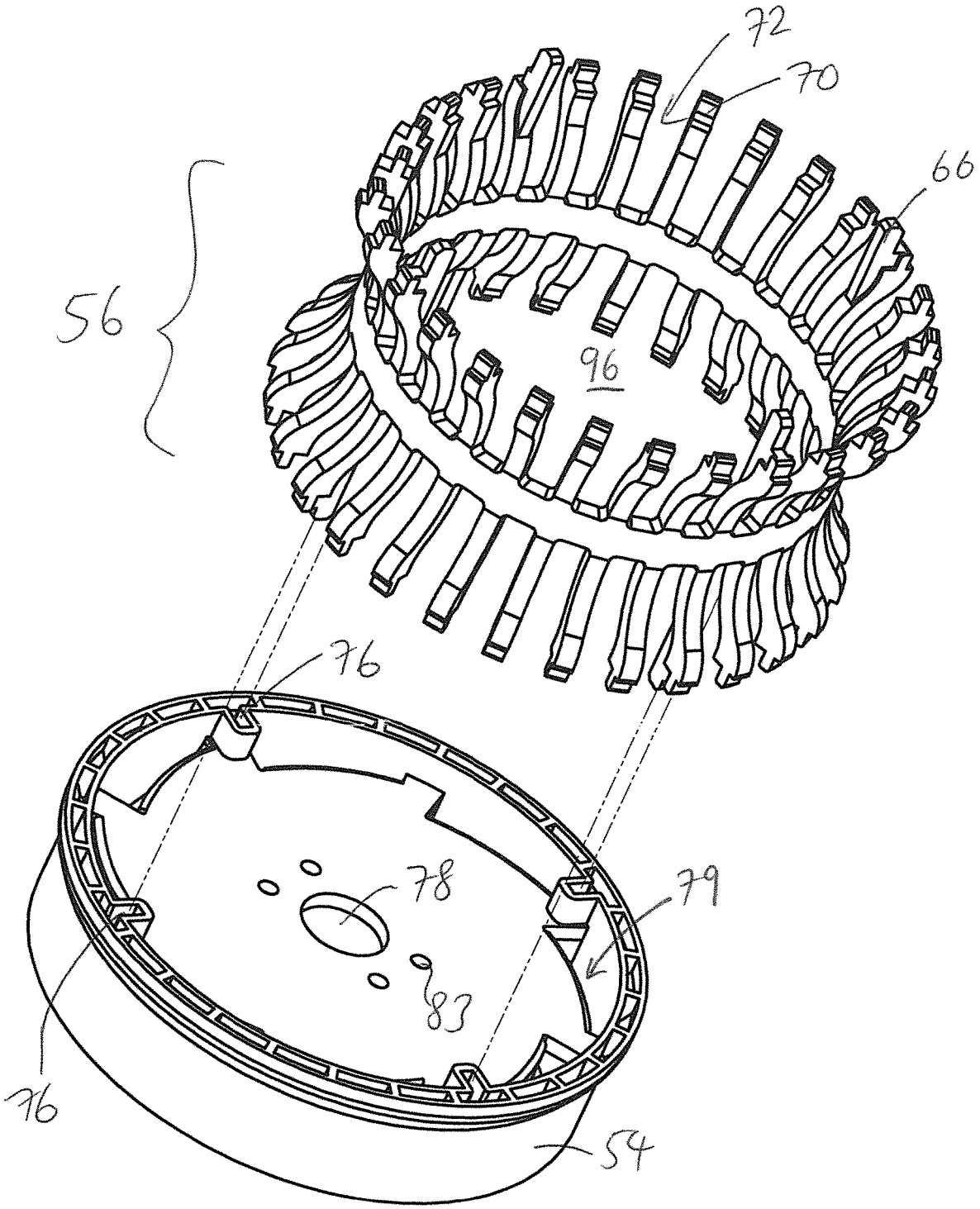
FIG. 6B is an exploded view illustrating the connection of the intake motor support and the protective net.
Figure 7:
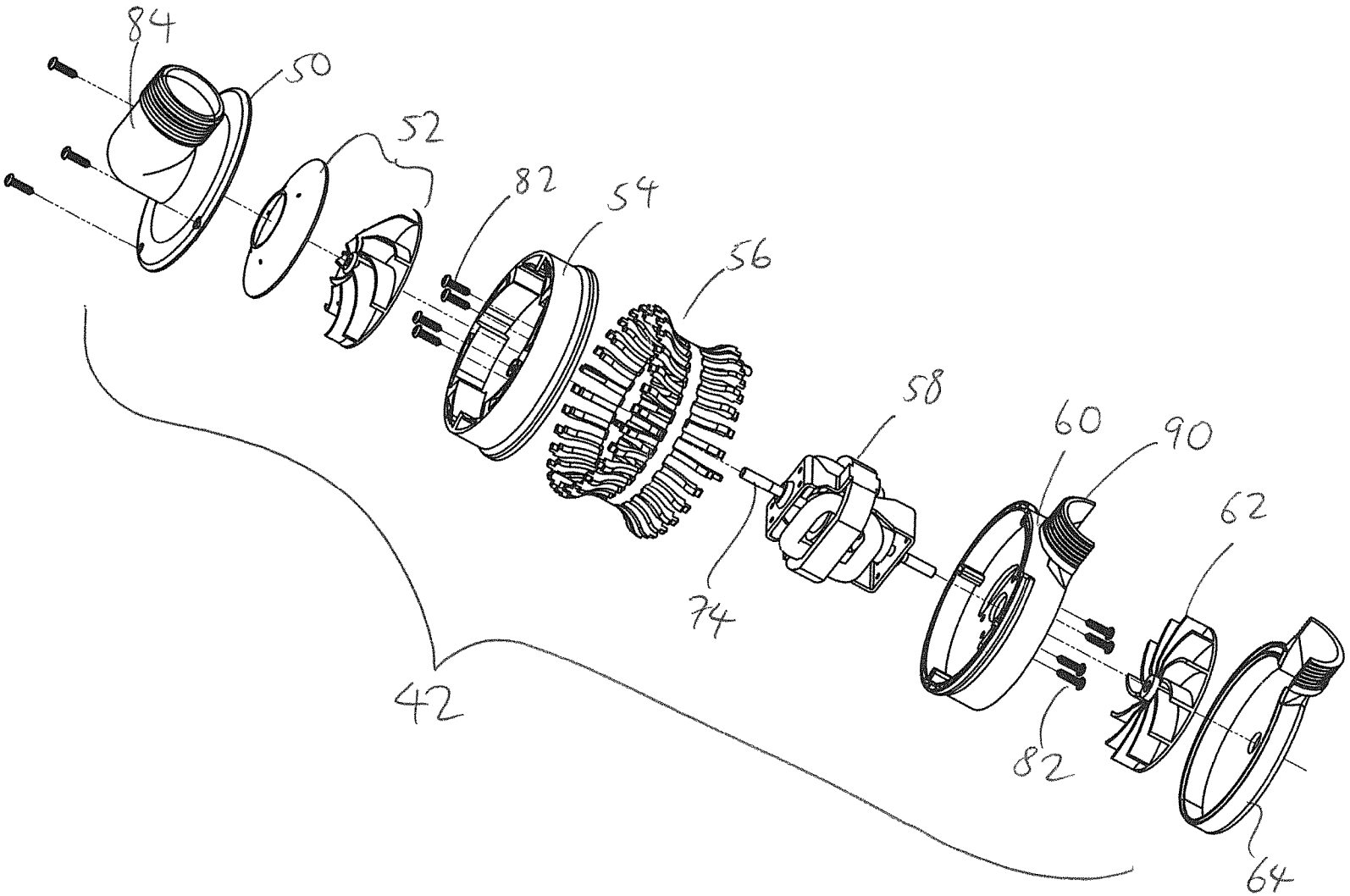
FIG. 7 is an exploded view of the double blower assembly of the pump assembly of FIGS. 1-5.

Referring to FIGS. 6A, 6B and 7, the double-blower assembly 42 has an intake cover 50, an intake blower 52, an intake motor support 54, a protective net 56, a motor 58, an exhaust motor support 60, an exhaust blower 62 and an exhaust cover 64. The intake cover 50 and the intake motor support 54 are secured together to define an intake housing having a chamber with the intake blower 52 housed therein, and the exhaust cover 64 and the exhaust motor support 60 are secured together to define an exhaust housing having a chamber with the exhaust blower 62 housed therein.

The protective net 56 is secured between the two motor supports 54 and 60. In particular, as best shown in FIGS. 6A, 6B and 7, the protective net 56 is made of a plurality of net strands 70, with four net strands having notches 66 at their ends that are adapted to be fitted into aligned holes 76 that are provided in spaced-apart manner along the periphery of the motor supports 54 and 60. The motor 58 is housed inside the protective net 56, and screws 82 can be used to secure the motor 58 to the two motor supports 54 and 60 via openings 83, thereby causing the protective net 56 to be retained in place between the two motor supports 54 and 60. The strands 70 of the protective net 56 can be made from a polymer material, such as Acrylonitrile Butadiene Styrene (ABS), and spaces 72 are defined between adjacent strands 70. These spaces 72 extend circumferentially around the protective net 56. The net 56 can have a concave or V-shape.

The motor 58 has a single shaft 74 having a first end that extends through an opening 78 in the intake motor support 54 to be connected to the intake blower 52, and a second end that extends through an opening 80 in the exhaust motor support 60 to be connected to the exhaust blower 62.

The intake cover 50 has a hollow L-shaped arm or elbow 84 extending therefrom and is threadably coupled to the intake connection tube 44. Similarly, the exhaust cover 64 has an outlet port 90 (see FIG. 7) extending upwardly therefrom and is coupled to the exhaust connection tube 46.

Openings 79 and 81 are provided in the inner walls of the motor supports 54 and 60, respectively, (see FIGS. 6A and 6B) allow air to be transferred to and from the chambers of the intake housing and exhaust housing, respectively, to the region 96 surrounded by the protective net 56. The openings 79 can be angular slits provided along the edge of the wall of the motor support 54 that also carries the opening 78, while the openings 81 can be two semi-circular openings provided on the same wall of the motor support 60 as the other opening 80. The motor 58 is retained or housed in this region 96. Thus, when air is being pumped from the external environment into the interior of the mattress body 24, the air passes through the tube 86 into the intake housing where the intake blower 52 directs the air out through the openings 79 to the region 96 surrounded by the net 56, and then the air escapes into the interior of the mattress body 24 via the spaces 72 between the strands 70. See FIG. 4 and the arrows that show the air flow. Conversely, when air is being pumped from the interior of the mattress body 24 to the external environment, the air is drawn in to the region 96 surrounded by the net 56 by the exhaust blower 62, and from the region 96 surrounded by the net 56, the air is drawn into the chamber of the exhaust housing via the openings 81, and then exits through the outlet port 90 through the tube 92 into the external environment. See FIG. 5 and the arrows that show the air flow. In this regard, it can be seen that positioning the motor 58 inside the region 96 surrounded by the net 56 allows the motor 58 to be cooled when air is either drawn in to, or drawn out from, the interior of the mattress body 24.

Control Housing Assembly 40

Referring to FIGS. 1, 3A, 3B, 4 and 5, the control housing assembly 40 has a housing that has an elongated generally rectangular section 102, and a storage section 104 that extends downwardly from one end of the rectangular section 102. A cover 106 covers the opened upper end of the rectangular section 102, and together with the rectangular section 102, defines an interior compartment 108. Four openings are provided in the cover 106, an intake opening 110, an exhaust opening 112, a control button opening 114, and a storage opening 116.

An intake knob 118 extends through the intake opening 110. An exhaust knob 120 extends through the exhaust opening 112. A control button 122 extends through the control button opening 114. A storage lid 124 is pivotably coupled to the storage opening 116. The storage section 104 can be used to house the electrical wiring and power plug 98, with access to the internal storage space 126 of the storage section 104 provided by lifting or closing the storage lid 124. The storage section 104 can also be a battery compartment (not shown) if the pump assembly 20 is used with a DC motor. The control button 122 is used to turn the motor 58 on or off. In this regard, the control button 122 is coupled to wires 130 that electrically connect the control button 122 to the motor 58.

Figure 8A:
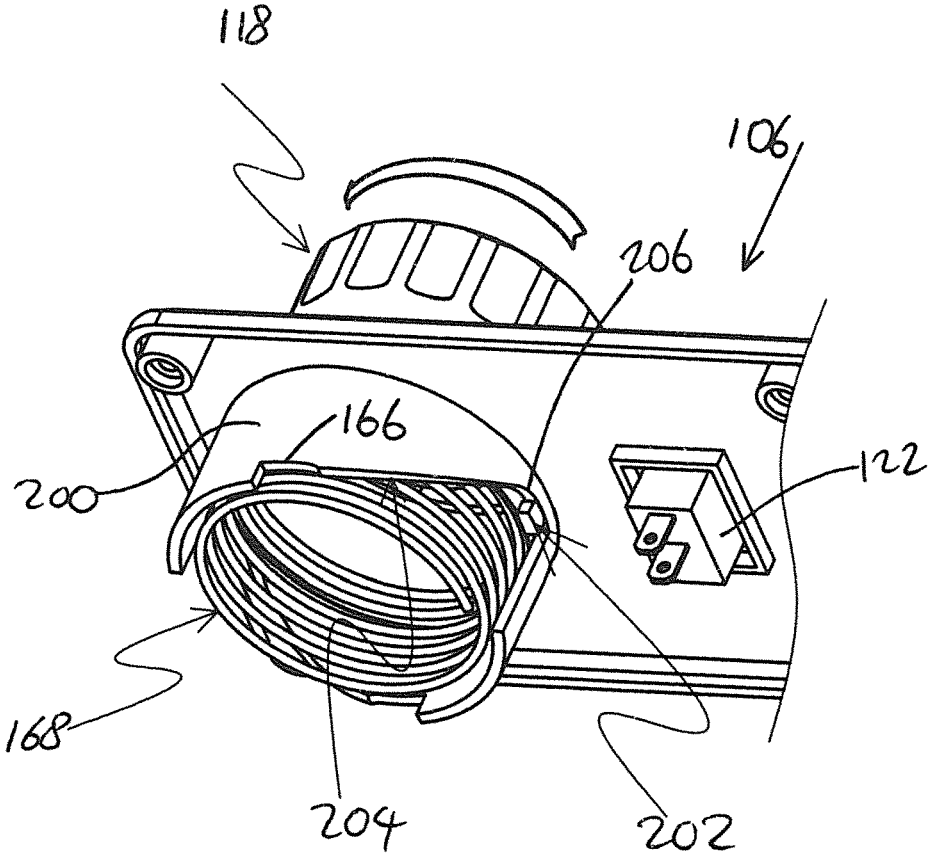
FIGS. 8A and FIG. 8B illustrate how the knob is opened and closed.
Figure 8B:
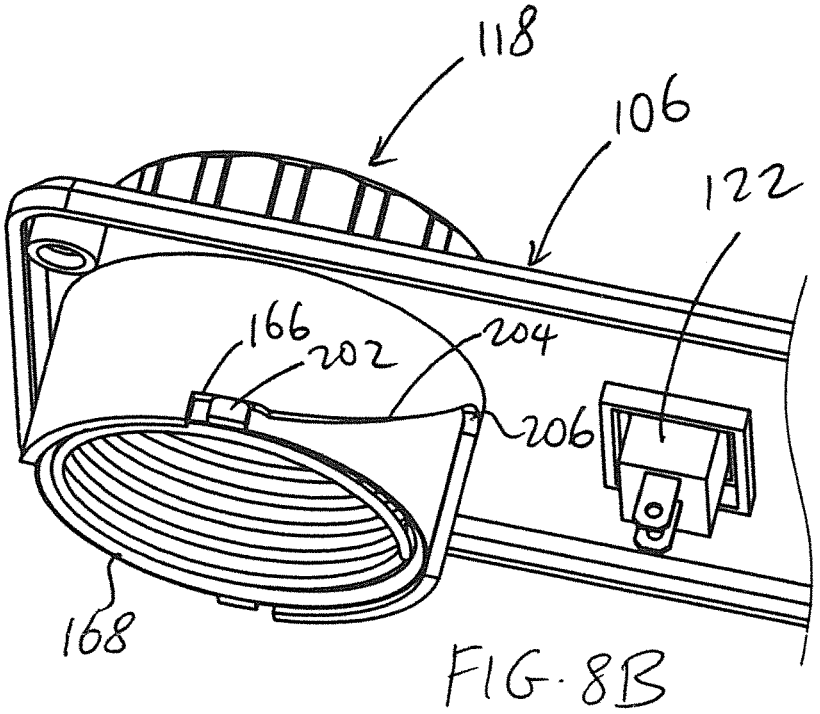

The intake knob 118 has a hollow cylindrical body 136 that can have ribbed outer surfaces 138 to allow the user to grip and turn the knob 118. A generally circular central hub 140 is provided at the upper end of the knob 118, with the hub 140 connected to the body 136 by spokes 142. Air passages 144 are defined between the spokes 142. The central hub 140 extends into the hollow interior of the body 136 and terminates at a holder 146. A flange 148 extends around the external wall of the hub 140, and a silicone seal 150 is positioned under the flange 148 and secured by the holder 146. The holder 146 has a conical shape so that it can more efficiently direct airflow. In addition, the thickness of the body 136 adjacent its upper end is slightly greater than the thickness elsewhere, so as to define an annular ridge 152. A latch button 202 is provided on the outer surface of the cylindrical body 136 adjacent the lower end thereof. See also FIGS. 8A and 8B.

A cylindrical guide wall 200 extends downwardly from the opening 110 in the cover 106. A portion of the cylindrical wall of the guide wall 200 is cut out to define a rest shoulder 206, a guide rail surface 204, and a slot 166. The latch button 202 is adapted to be seated in the rest shoulder 206 when the knob 118 is opened (see FIG. 8A), is adapted to slide downwardly along the guide rail surface 204, and to be secured at the slot 166 when the knob 118 is closed (see FIG. 8B).

A first cylindrical wall 160 is defined inside the rectangular section 102 under the intake opening 110. A second cylindrical wall 162 is defined inside the first cylindrical wall 160, and extends through an opening 164 in the bottom wall of the rectangular section 102 to an annular flange 100. See FIG. 5. The annular flange 100 is adapted to communicate with the open upper end of an inner tube 86; in particular, the open upper end of the inner tube 86 extends into and through the opening 164 surrounded by the flange 100. The interior of the second cylindrical wall 162 defines an air channel 180 that communicates with the tubes 86 and 44 via the opening 164. A spring 168 is adapted to be seated in the space 170 between the two cylindrical walls 160 and 162, surrounding the second cylindrical wall 162.

The intake knob 118 is adapted to extend through the intake opening 110 and has an annular lower lip 172 that functions to retain the knob 118 inside the space 170 by engaging an annular ledge 174 defined at the intake opening 110 at the cover 106. The spring 168 is seated in the space 170 and extends upwardly to surround the central hub 140, with the upper end of the spring 168 abutting the annular ridge 152 to retain the upper end of the spring 168 inside the knob 118.

In use, the knob 118 can be turned clockwise to seal the air channel 180 by turning and pressing the knob 118 down, and which causes the latch button 202 to travel from the rest shoulder 206 to the slot 166. In this position, the holder 146 extends into the interior of the second cylindrical wall 162 and the silicone seal 150 and the flange 148 sit on the annular upper edge of the second cylindrical wall 162 to seal the air channel 180 shut. In addition, in this position, the bottom edge of the body 136 sits adjacent the bottom of the cylindrical walls 160 and 162. See FIG. 5.

Figure 4:
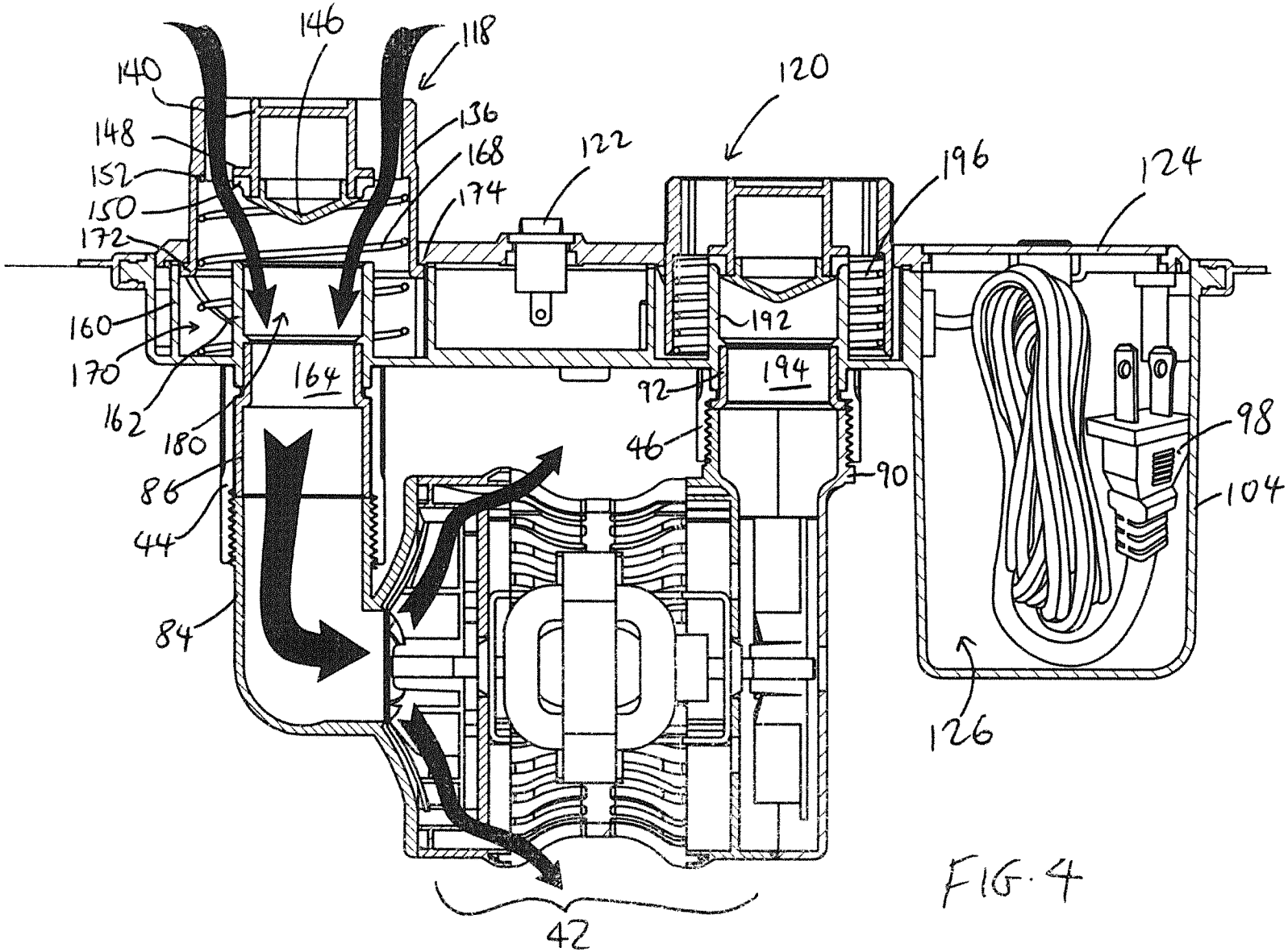
FIG. 4 is a cross-sectional view of the pump assembly of FIGS. 1-3 showing the intake of air into the mattress.
Figure 5:
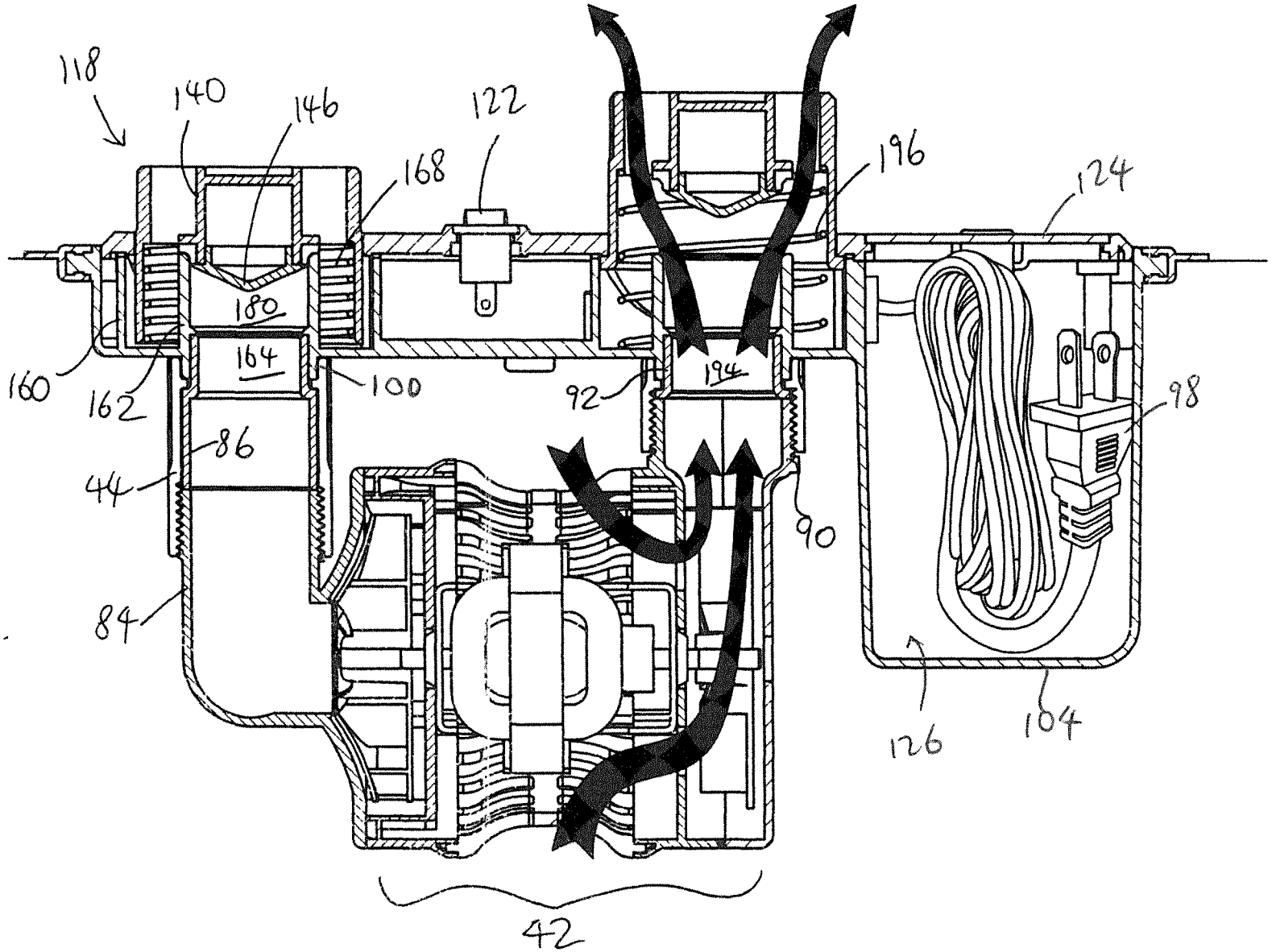
FIG. 5 is a cross-sectional view of the pump assembly of FIGS. 1-3 showing air being pumped out of the mattress.

The knob 118 can also be turned counter-clockwise to open the intake opening 110. Turning the knob 118 counter-clockwise will allow the bias of the spring 168 to automatically cause the knob 118 to be pushed up, causing the latch button 202 to move from the slot 166 to the rest shoulder 206. The annular lower lip 172 retains the knob 118 inside the space 170 by engaging the annular ledge 174 defined at the intake opening 110 at the cover 106 to prevent the knob 118 from being disengaged from the cover 106. Ambient air can now pass through the air passages 144 into the interior of the body 136, and then travel into the air channel 180, through the opening 164, and into the tube 86 and then the arm 84. As best shown in FIG. 4, the bottom of the tube 86 communicates with the opened top end of the arm 84, with the connection tube 44 acting as a sleeve to encircle the lower end of the tube 86 and the upper end of the arm 84 by a threadable engagement.

The construction and operation of the exhaust knob 120 can be identical to that of the intake knob 118. Similarly, two cylindrical walls 190 and 192 can also be provided under the exhaust opening 112, and have the same construction, and operate in the same manner, as the cylindrical walls 160 and 162 under the intake opening 110.

In use, the knob 120 can be turned clockwise to seal the air channel 194 by turning and pressing the knob 120 down, and then engaging a latch button (not shown, but the same as 202) with a slot (not shown, but the same as 166). In this position, the central hub of the knob 120 extends into the interior of the second cylindrical wall 192 and a silicone seal (similar to 150) and a flange (similar to 148) sit on the annular upper edge of the second cylindrical wall 192 to seal the air channel 194 shut. In addition, in this position, the bottom edge of the body of the knob 120 sits adjacent the bottom of the cylindrical walls 190 and 192. See FIG. 4.

The knob 120 can also be turned counter-clockwise to open the exhaust opening 112. Turning the knob 120 counter-clockwise will cause the latch button to move from the slot to a rest shoulder, and the bias of the spring 196 will automatically cause the knob 120 to be pushed up. Air from inside the inflatable mattress 24 can now pass through the outlet port 90, and the inner tube 92 into the air channel 194, and then exit through the air passages 198 in the knob 120. See FIG. 5. The connection tube 46 acts as a sleeve to encircle the lower end of the tube 92 and the upper end of the outlet port 90 by a threadable engagement

Operation

When the inflatable mattress 24 is to be inflated, the user opens the intake knob 118 in the manner described above, and then presses the control button 122 to turn on the motor 58. As explained above, air is then delivered from the external environment through the air passages 144 into the air channel 180 and then into the tube 86, and then through the arm or elbow 84 into the intake housing where the intake blower 52 directs the air out through the openings 79 to the region 96 surrounded by the net 56, and then the air escapes into the interior of the mattress body 24 via the spaces 72 in the net 56. When the mattress 24 has been inflated, the user turns off the motor 58 by pressing the control button 122 again, and then pushes the intake knob 118 down to seal the air channel 180.

When the inflatable mattress 24 is to be deflated, the user opens the exhaust knob 120 in the manner described above, and then presses the control button 122 to turn on the motor 58. As explained above, the exhaust blower 62 draws air drawn into the region 96 surrounded by the net 56 via the spaces 72, and from the region 96 surrounded by the net 56, the air is drawn into the chamber of the exhaust housing via the openings 81, and then exits through the outlet port 90 through the tube 92, the air channel 194 and the air passages 198 into the external environment.

It should be noted that both blowers 52 and 62 are turned on during inflation and deflation. However, inflation and deflation performance is not negatively impacted because one of the knobs 118 or 120 seals either the inlet or the outlet shut, thereby creating a vacuum state for the inlet or outlet that is sealed

First Alternative Embodiment

Figure 9:
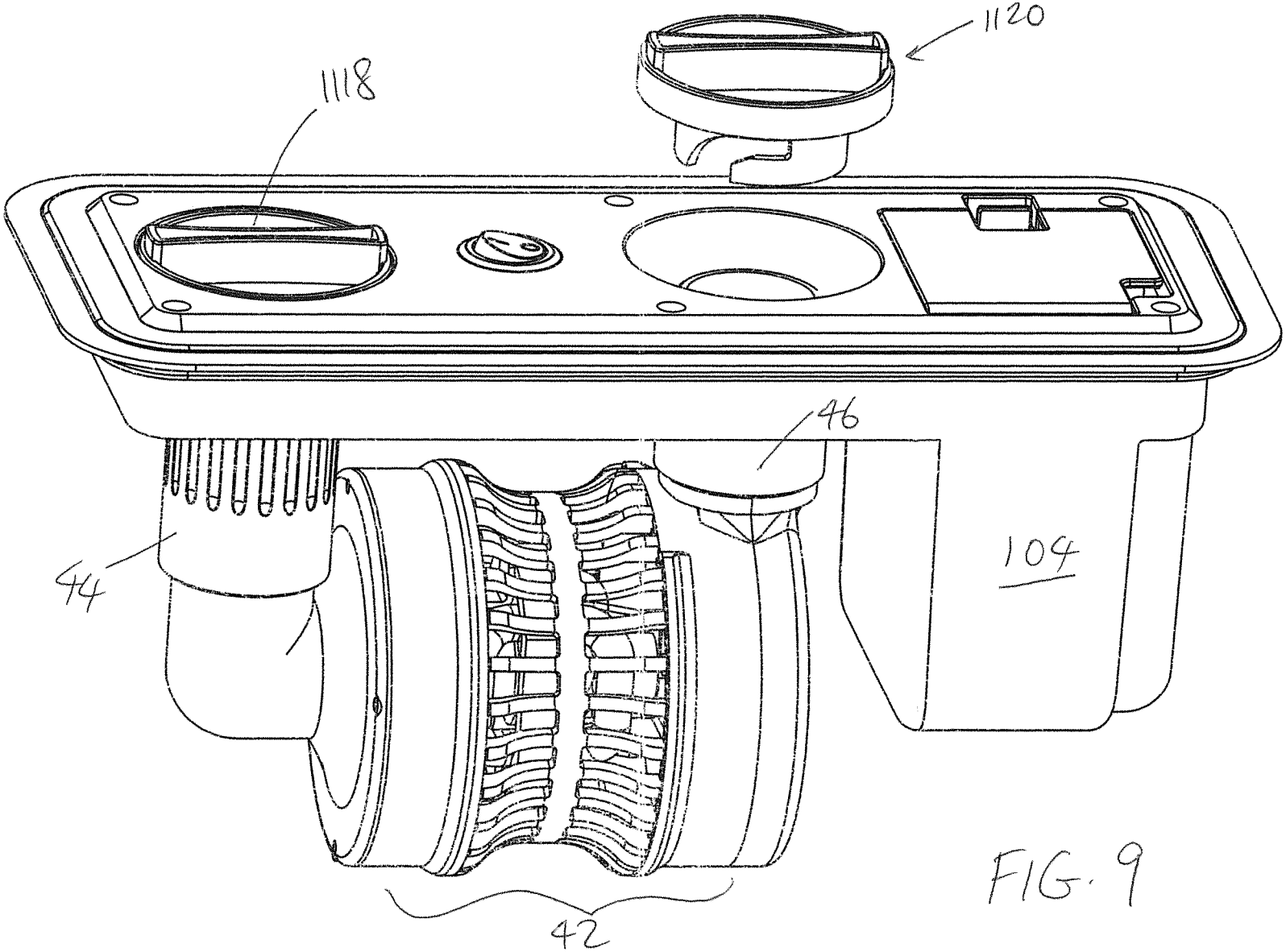
FIG. 9 is a perspective assembled view of the pump assembly according to yet another embodiment of the present invention.
Figure 10:
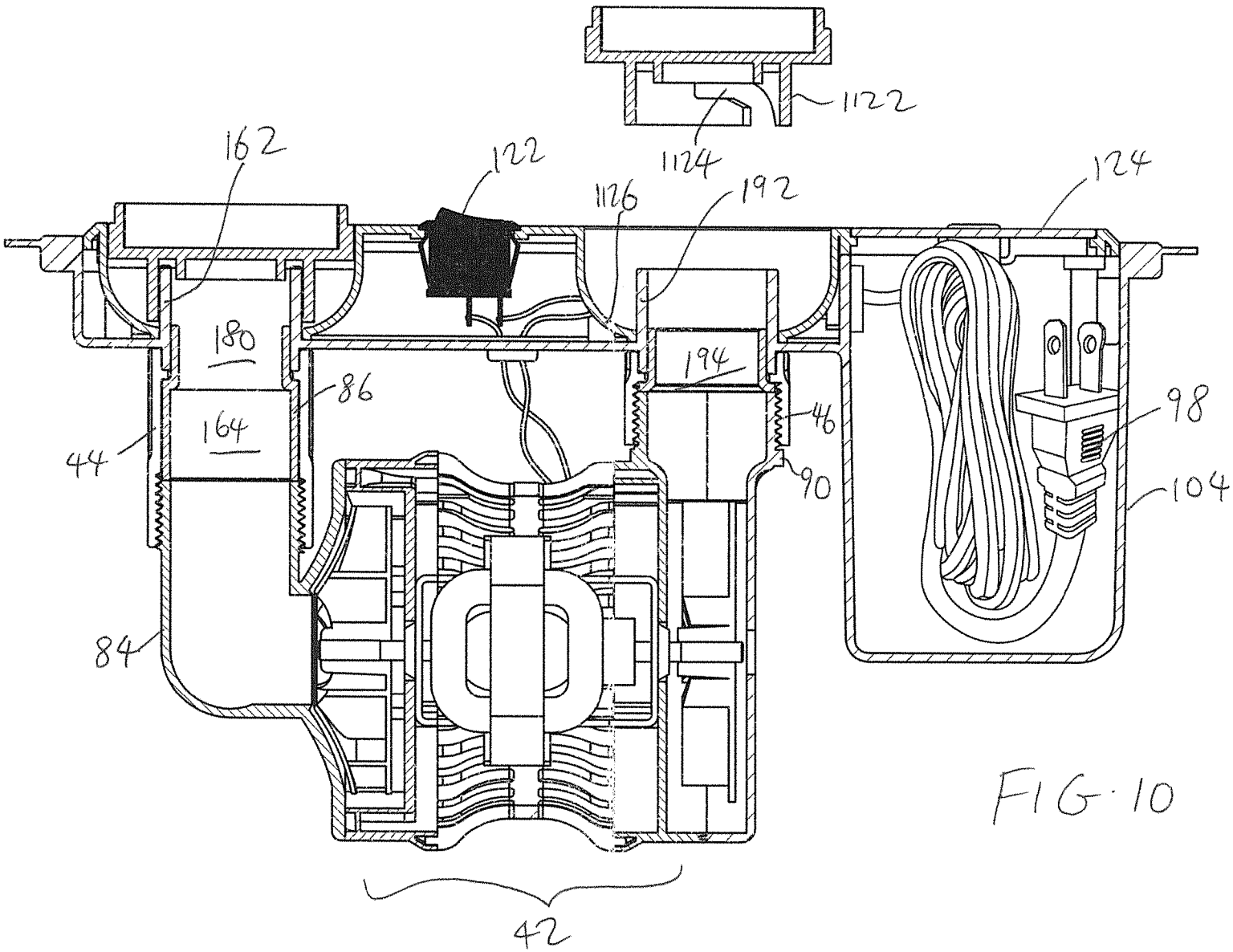
FIG. 10 is a cross-sectional view of the pump assembly of FIG. 9.
Figure 11:
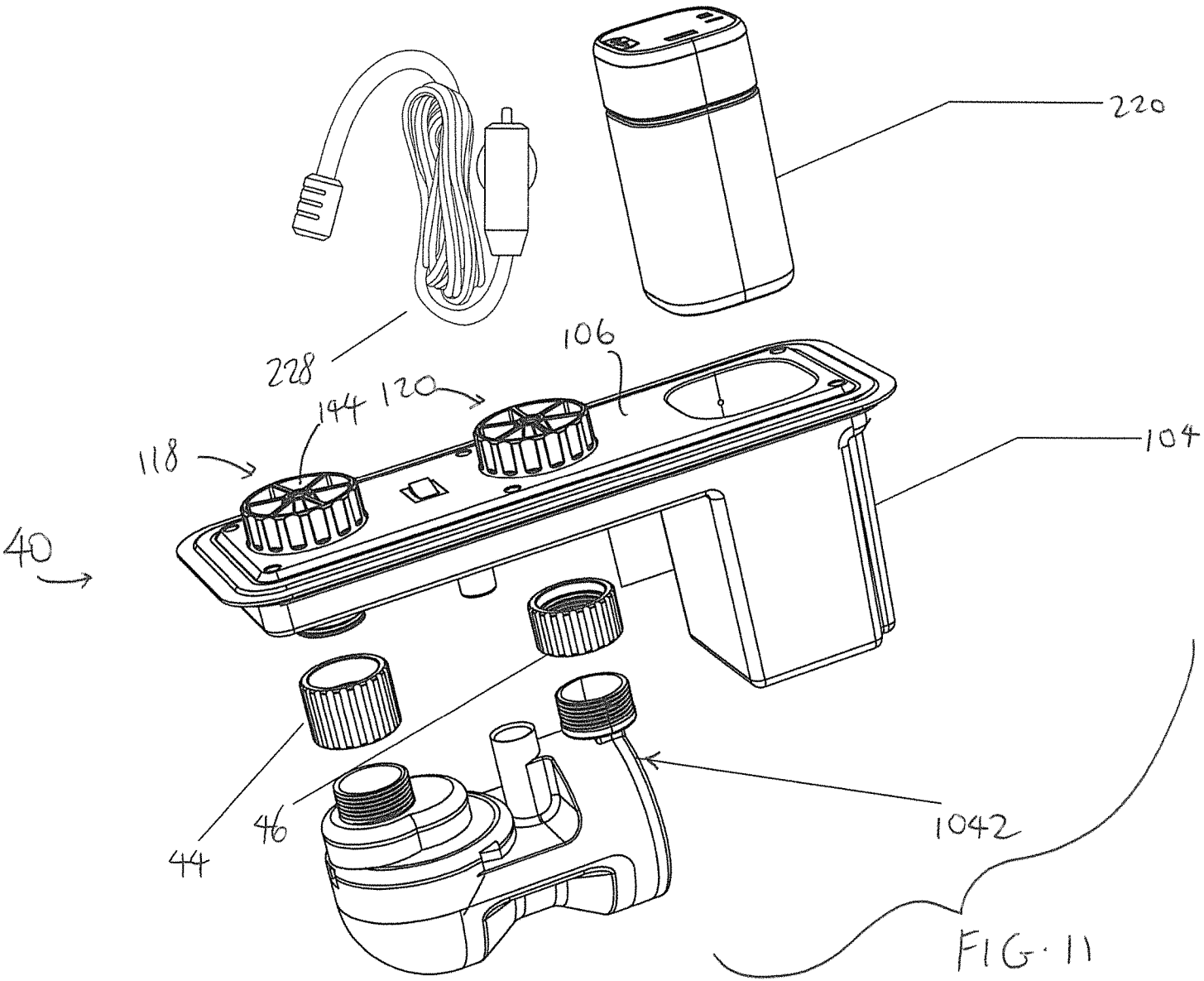
FIG. 11 is an exploded perspective view of the pump assembly according to yet another embodiment of the present invention.

FIGS. 9-10 illustrate another embodiment of the present invention. The embodiment in FIGS. 9-10 is the same as the embodiment in FIGS. 1-7, except that the knobs 118 and 120 are now replaced by screw caps 1118 and 1120. Otherwise, all the other elements that are the same as those in the embodiment of FIGS. 1-7 have the same numeral designations.

In the embodiment of FIGS. 9-10, the springs 168 are now omitted as they are unnecessary. Each screw cap 1118 and 1120 has a generally cylindrical ledge 1122 with a curved slot 1124 cut out of a portion of the ledge 1122. The curved slot 1124 is adapted to receive a curved ridge (not shown) extending from the base 1126 of the rectangular section 102. The ledge 1122 surrounds the cylindrical wall 162 or 192 when the screw cap 1118 or 1120 is screwed tight to shut the air channels 180 and 194. The inflate/deflate operations of this embodiment are identical to the inflate/deflate operations of the embodiment in FIGS. 1-7.

Benefits

The pump assembly 20 of the present invention provides a number of important benefits. First, the construction of the double-blower assembly 42 with the motor 58 supported between the two blowers 52 and 62 allows air to be delivered into and out of the body 24 very quickly. In particular, the air that is drawn in by the intake blower 52 exits the intake motor support 54 and spreads out very quickly around the motor 58, through the net 56 and into the body 24. Conversely, air that is drawn from the body 24 by the exhaust blower 62 can enter the exhaust motor support 60 from all over the net 56 and the motor 58, thereby speeding up the exhaust of air from the body 24. In fact, the net 56 can even be omitted to provide less obstruction to the air flow.

Second, the double-blower assembly 42 of the present invention improves efficiency. For example, by increasing power by only 8%, the double blower assembly 42 can achieve an increase in pressure by 60%.

Third, unlike many conventional pump units which utilize the same channels and tubes to draw in air and to exhaust air, the double blower assembly 42 of the present invention provides separate and independent inlets and outlets, which greatly reduces the loss caused by the flow resistance of the compressed air. This provides for rapid inflation and maximized air compression, with compression flow increased by more than 150% compared with the traditional pumps in the market Fourth, the construction of the double blower assembly 42 is simple, thereby making it easier and cheaper for mass production and after-sale service.

Second Alternative Embodiment

FIGS. 11-15 illustrate another embodiment of the present invention. The embodiment in FIGS. 11-15 is the same as the embodiment in FIGS. 1-8B, except that the double-blower assembly has been replaced by a double-blower double-motor assembly 42. The control housing assembly 40 can be the same as for FIGS. 1-8B, and the same numerals are used in FIGS. 1-8B and 11-14 to represent the same elements. In addition, a battery assembly 220 can be housed inside a battery housing 222 that is secured inside the storage section 104. A DC plug 224 can be electrically coupled to the battery housing 222 and the control button 122. A separate charging assembly 228 can be provided for charging the battery assembly 220.

The double-blower double-motor assembly 1042 has a housing frame 230 that supports two motors 232 and 234, and two blowers 242 and 244 that are coupled to the motors 232 and 234, respectively, via shafts 282 and 292, respectively. A blower 242 is oriented horizontally on a flat platform 252 on an upper surface of the frame 230 that is defined by an enclosing wall 250, and an upper cover assembly forms an intake chamber with the platform 252. The upper cover assembly includes a cover plate 262*a* that covers the blower 242, with the cover plate 262*a* having an opening 266 aligned with the central shaft of the blower 242, and an enclosing wall section 268 that defines an input chamber 298 (see FIG. 14). A top plate 262*b* is shaped similar to the wall section 268 and covers the wall section 268 to define the input chamber 298. An inlet port 276 is provided on the top plate 262*b* and is adapted to be threadably connected to the connection tube 44. An opening 270 (see FIG. 13) is provided in the enclosing wall 250 and the wall of the cover plate 262*a*.

The other blower 244 is oriented vertically on another flat platform 254 on a side surface of the frame 230 that is defined by an enclosing wall 248, and a side cover 264 forms an outlet chamber 286 (see FIG. 14) with the platform 254. The side cover 264 covers the blower 244, and has openings 290 for allowing air from the mattress body 24 to be drawn into the outlet chamber 286. An opening 288 is provided in the enclosing wall 248 and the wall of the side cover 264 for an outlet port 278 which is adapted to be threadably connected to the connection tube 46. The two motors 232 and 234 are secured below the platform 252 in a space that is defined by the lower housing 280 of the double-blower double-motor assembly 1042. The two blowers 242 and 244 are oriented ninety degrees apart from each other, and the openings 270 and 290 are also oriented ninety degrees apart from each other.

Figure 12:
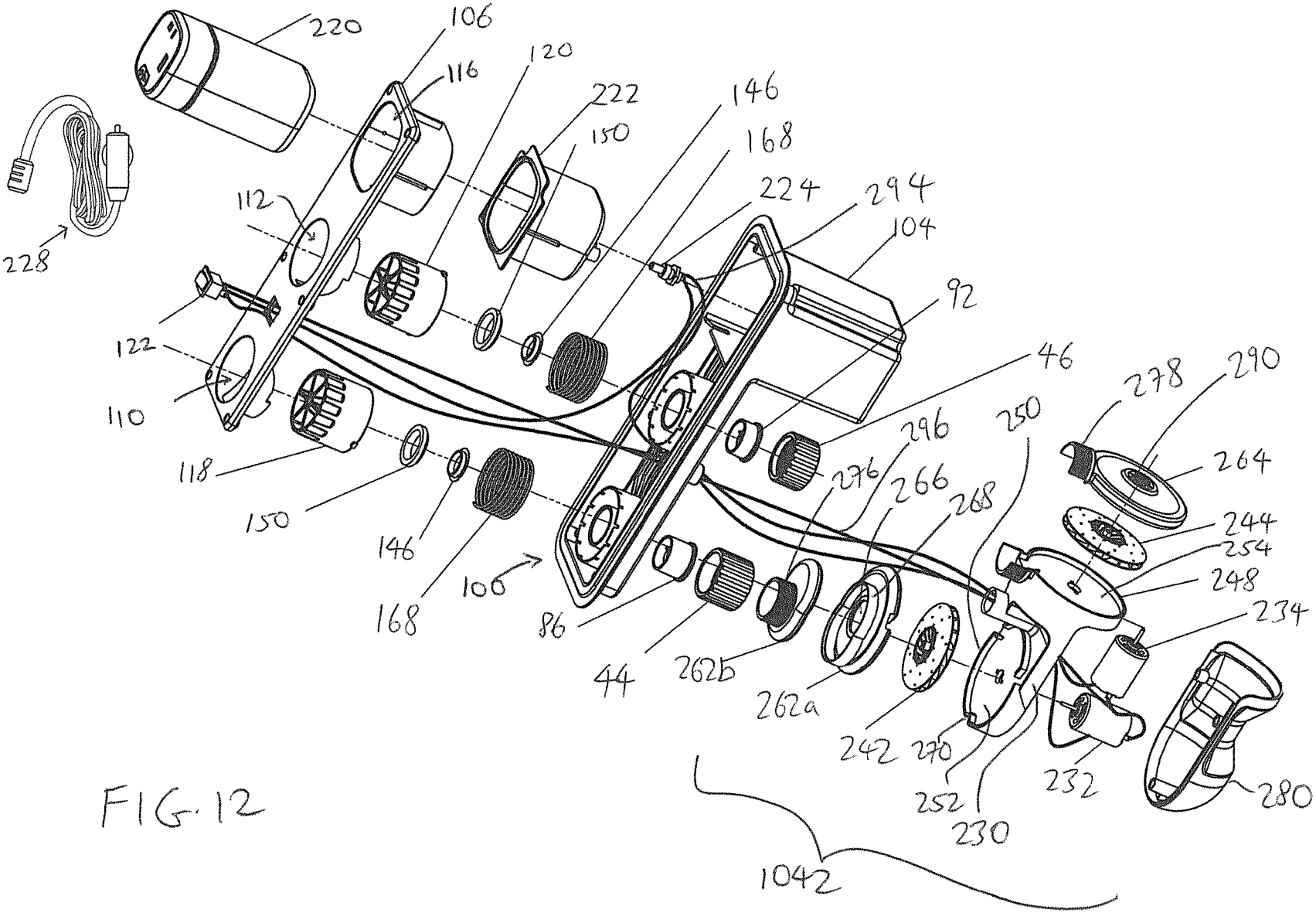
FIG. 12 is an exploded cross-sectional view of the pump assembly of FIG. 11.
Figure 13:
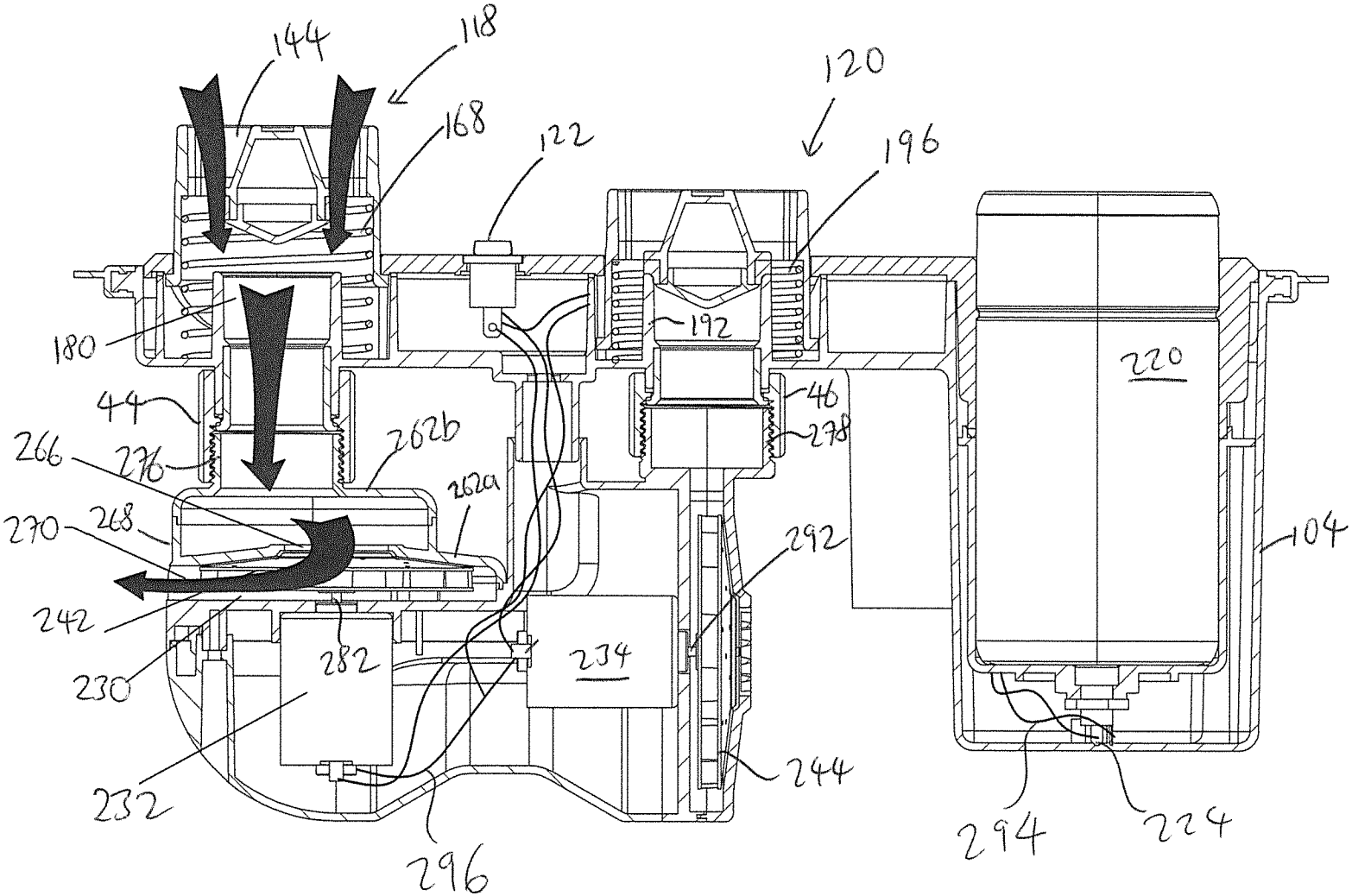
FIG. 13 is a cross-sectional view of the pump assembly of FIGS. 11-12 showing the intake of air into the mattress.
Figure 14:
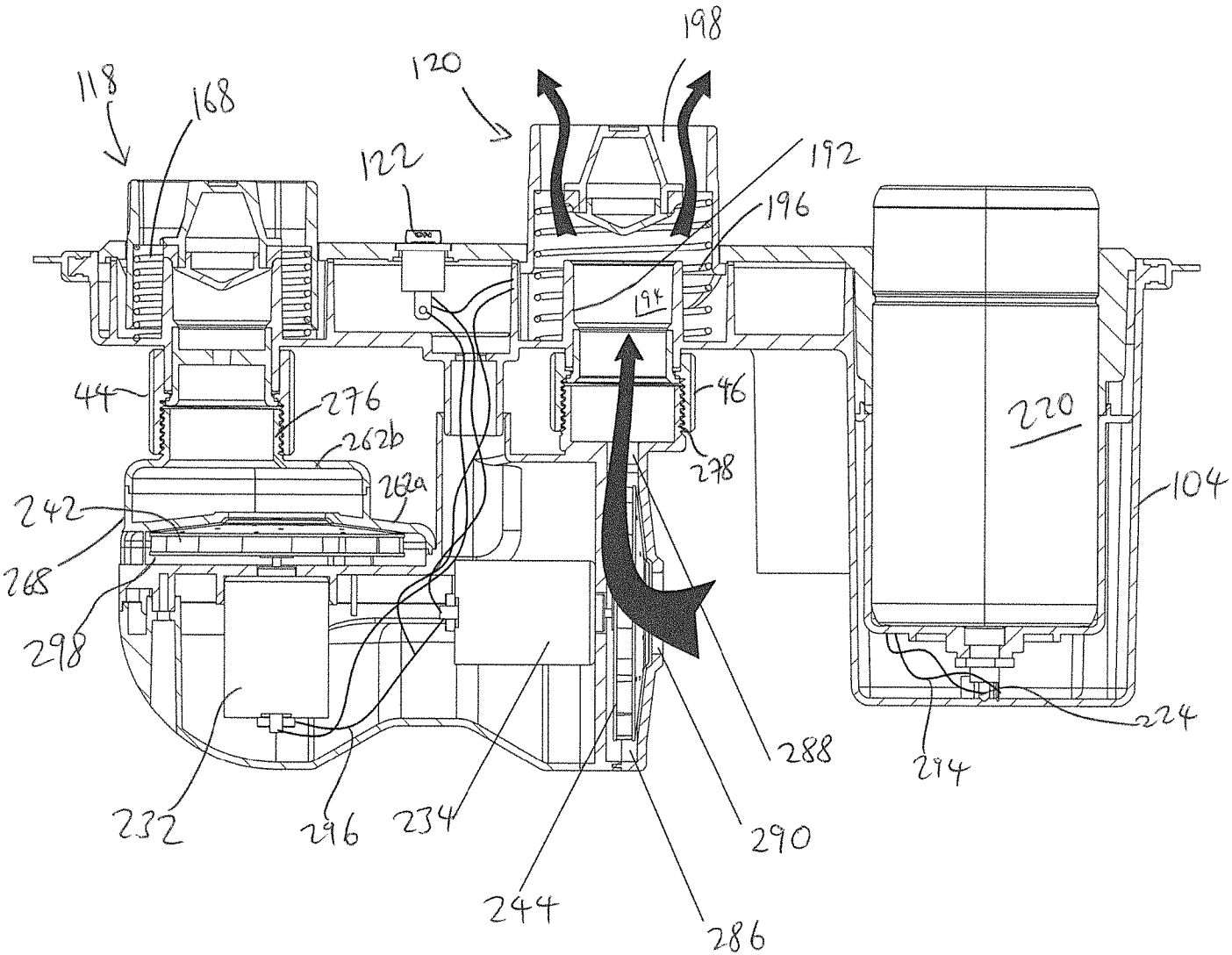
FIG. 14 is a cross-sectional view of the pump assembly of FIGS. 11-12 showing air being pumped out of the mattress.
Figure 15:
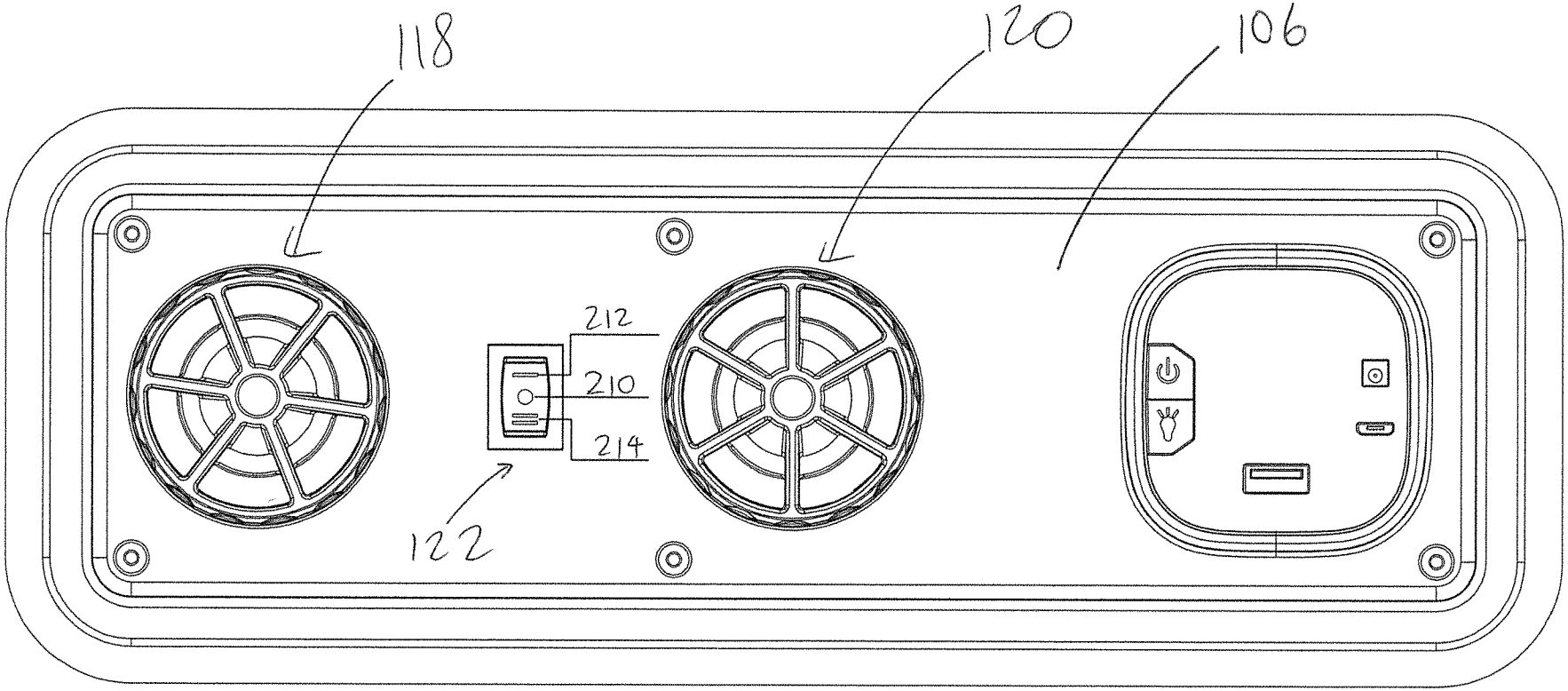
FIG. 15 is a top view of the pump assembly of FIG. 11.

As best shown in FIGS. 12-14, wiring 294 electrically connects the control button 122 with the DC plug 224, and wiring 296 electrically connects the control button 122 with the motors 232 and 234. In addition, as shown in FIG. 15, the control button 122 is now a two-step control button, where it normally assumes a rest position 210 but can be pressed to one position 212 to actuate the motor 232, or pressed to the other position 214 to actuate the motor 234.

As shown in FIG. 13, when the inflatable mattress 24 is to be inflated, the user opens the intake knob 118 in the manner described above, and then presses the control button 122 towards position 212 turn on the motor 232. As explained above, air is then delivered from the external environment through the air passages 144 into the air channel 180 and then into the tube 86, and then through the inlet port 276 into the input chamber 298, where the intake blower 242 directs the air out through the opening 270 into the mattress 24. When the mattress 24 has been inflated, the user turns off the motor 232 by pressing the control button 122 again to the position 210, and then pushes the intake knob 118 down to seal the air channel 180.

As shown in FIG. 14, when the inflatable mattress 24 is to be deflated, the user opens the exhaust knob 120 in the manner described above, and then presses the control button 122 to the position 214 to turn on the motor 234. As explained above, the exhaust blower 244 draws air from the mattress 24. The air is drawn into the outlet chamber 286 via the openings 290, and then exits through the outlet port 278 through the tube 92, the air channel 194 and the air passages 198 into the external environment.

It should be noted that only one blower 242 or 244 is turned on during inflation and deflation.

Third Alternative Embodiment

Figure 16:
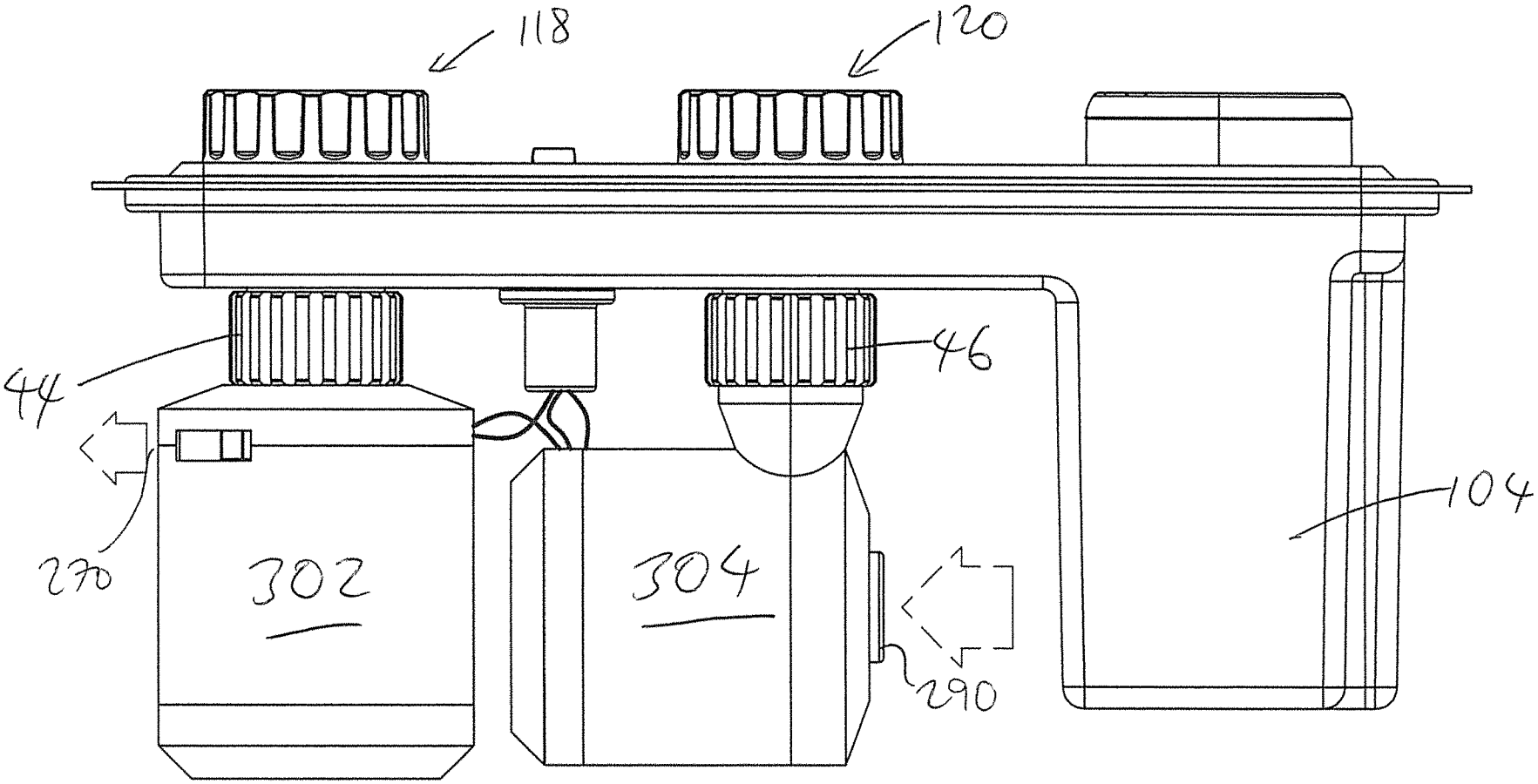
FIG. 16 is an assembled perspective view of the pump assembly according to yet another embodiment of the present invention.

FIG. 16 illustrates another embodiment of the present invention. The embodiment in FIG. 16 is the same as the embodiment in FIGS. 11-15, except that the single housing frame 230 and lower housing 280 is replaced by separate housings 302 and 304, each for housing a separate set of blowers and motors. With the locations and orientations of the openings 270 and 290 remaining the same as in FIGS. 11-14, the orientations and locations for the blowers and motors in the housings 302 and 304 can be similar to those in FIGS. 11-14.

Figure 17:
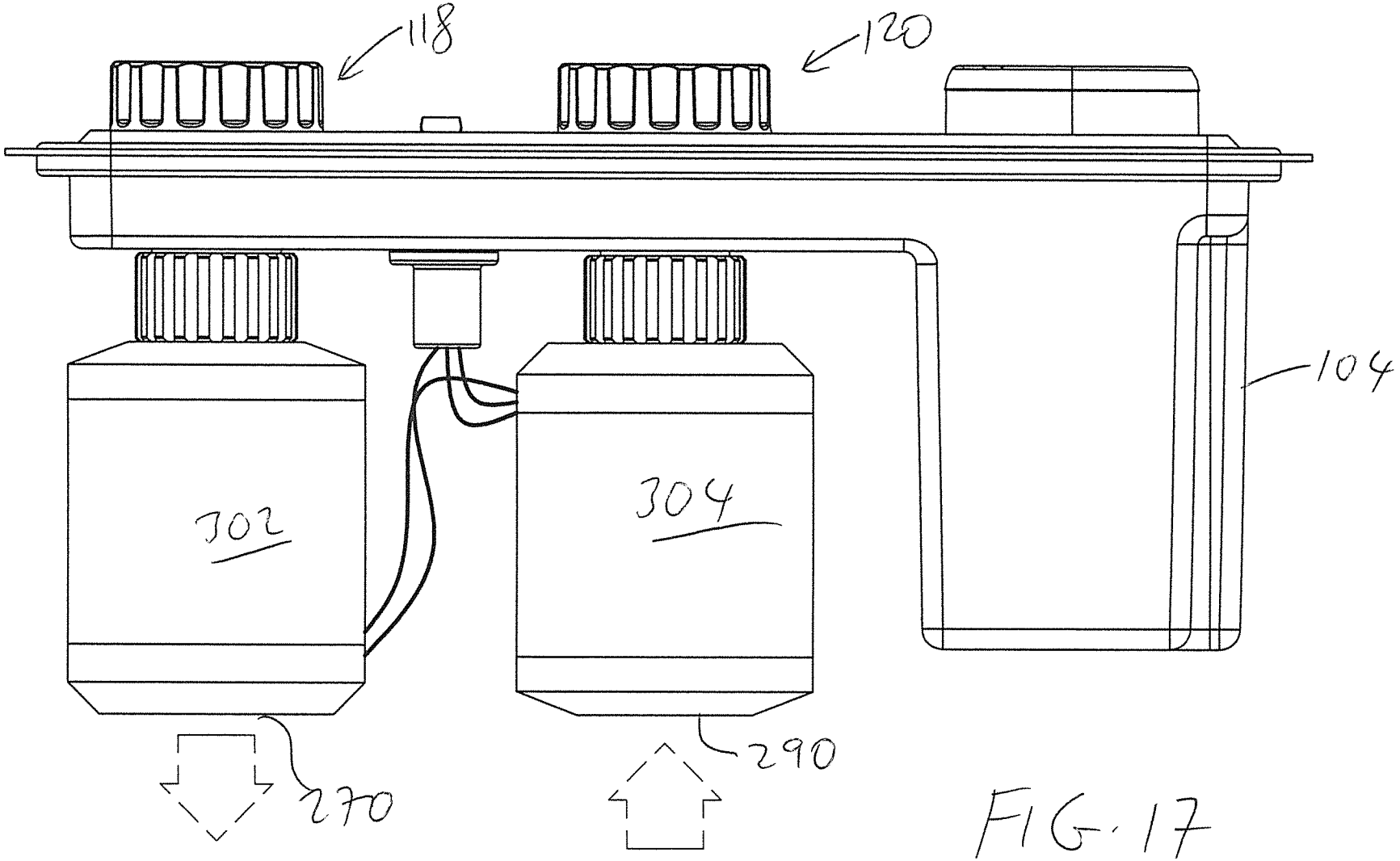
FIG. 17 illustrates a modification that can be made to the pump assembly of FIG. 16.

FIG. 17 illustrates a modification that can be made to the embodiment in FIG. 16, where the openings 270 and 290 are provided at different locations and orientations.

Fourth Alternative Embodiment

Figure 18:
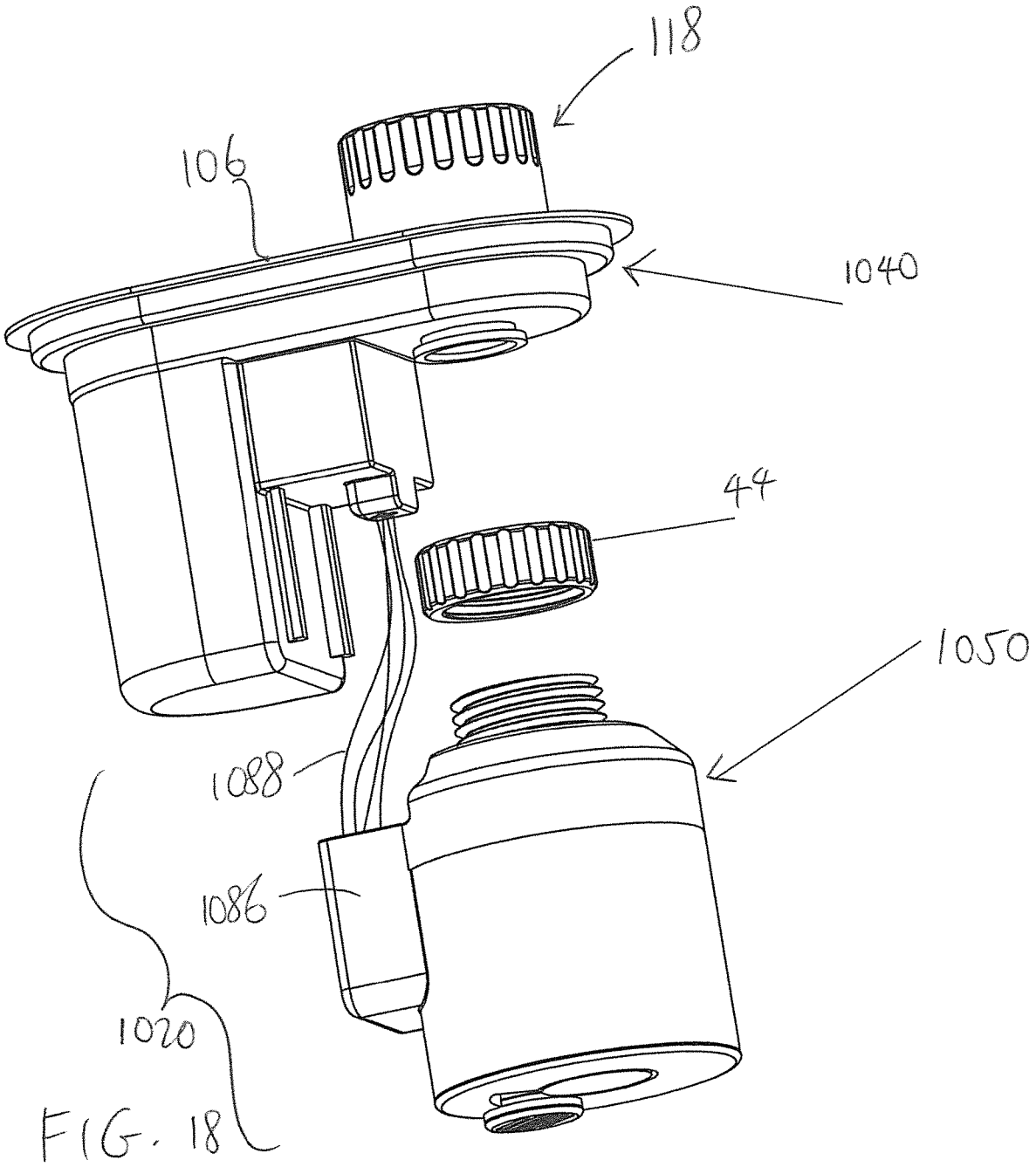
FIG. 18 is an exploded perspective view of the pump assembly according to yet another embodiment of the present invention.
Figure 19:
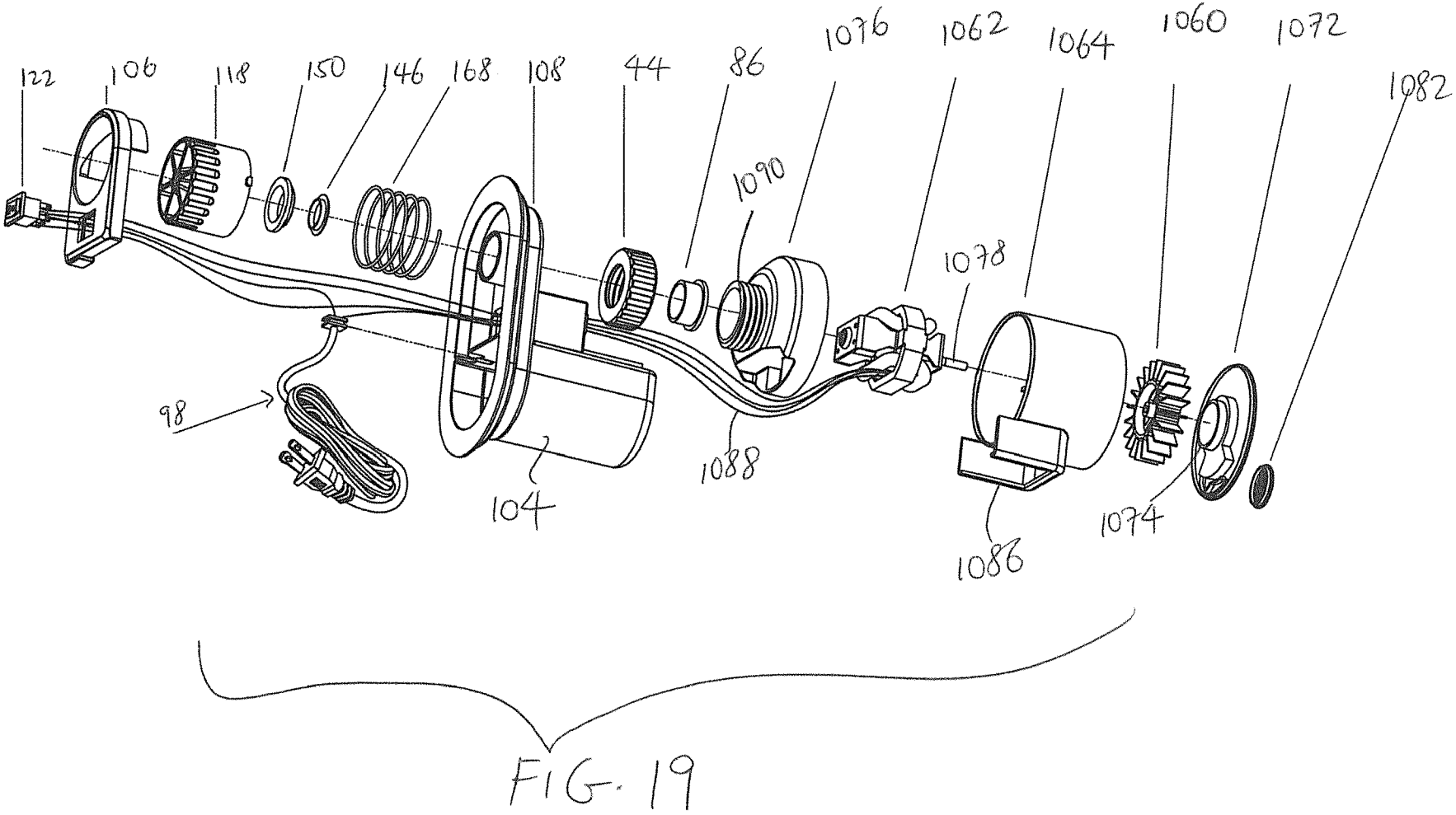
FIG. 19 is an exploded cross-sectional view of the pump assembly of FIG. 18.

FIGS. 18-22 illustrate another embodiment of the present invention. The embodiment in FIG. 18 is similar to the other embodiments, except that the pump assembly 1020 has a pump unit 1050 that has a single blower and a single motor that functions to pump air into the mattress 24, and to remove air from the mattress 24. The single motor can be a bi-directional motor that rotates in opposite directions to pump or remove air.

Referring to FIGS. 18-22, the pump assembly 1020 has a control housing assembly 1040 that is essentially the same as the control housing 40 except that the output channel and its components (e.g., the knob 120, the exhaust opening 112, the spring 196, the air channel 194, the connection tube 46, and the tube 92) are omitted, and the size is reduced. One channel (e.g., the input channel that comprises the knob 118, the opening 110, the spring 168, the air channel 180, the connection tube 44, and the tube 86) remains the same and functions as a single air channel to pump air from the outside environment into the mattress 24, and to pump air from the mattress 24 to the outside environment.

The pump unit 1050 has a single blower 1060 and a single motor 1062 housed inside a housing 1064 that has a blower compartment 1066 that is separate from a motor compartment 1068. See FIG. 20. The compartments 1066 and 1068 are separated by a platform 1070. A lower lid 1072 is secured to the base of the housing 1064, and together with the platform 1070 defines the blower compartment 1066. The blower 1060 is seated on an annular ridge 1074 for rotation. An upper lid 1076 is secured to the top of the housing 1064, and together with the platform 1070 defines the motor compartment 1068. The motor 1062 is secured inside the compartment 1068 for rotation, and has a motor shaft 1078 extending from its lower end through an opening in the platform 1070 to be coupled to the blower 1060 for rotating the blower 1060. The upper lid 1076 has a threaded mouth 1090 that is adapted to be threadably connected to the internal threads of the connection tube 44.

The lower lid 1072 has an inlet/outlet opening 1080 that is provided in a location offset from the center of the lower lid 1072, almost to the circumference of the lower lid 1072. A grille cap 1082 is provided to cover the opening 1080. A chamber opening 1084 is also provided in the platform 1070 at a location offset from the center of the platform 1070, and also spaced apart from the opening 1080. The positions of the openings 1080 and 1084 are best shown in FIGS. 20-22.

A well 1086 can be provided along the outer surface of the housing 1064 to receive wires 1088 that extend from the control button 122. The wires 1088 electrically couple the control button 122 to the motor 1062. The control button 122 can be the same as shown in FIG. 15.

Figure 20:
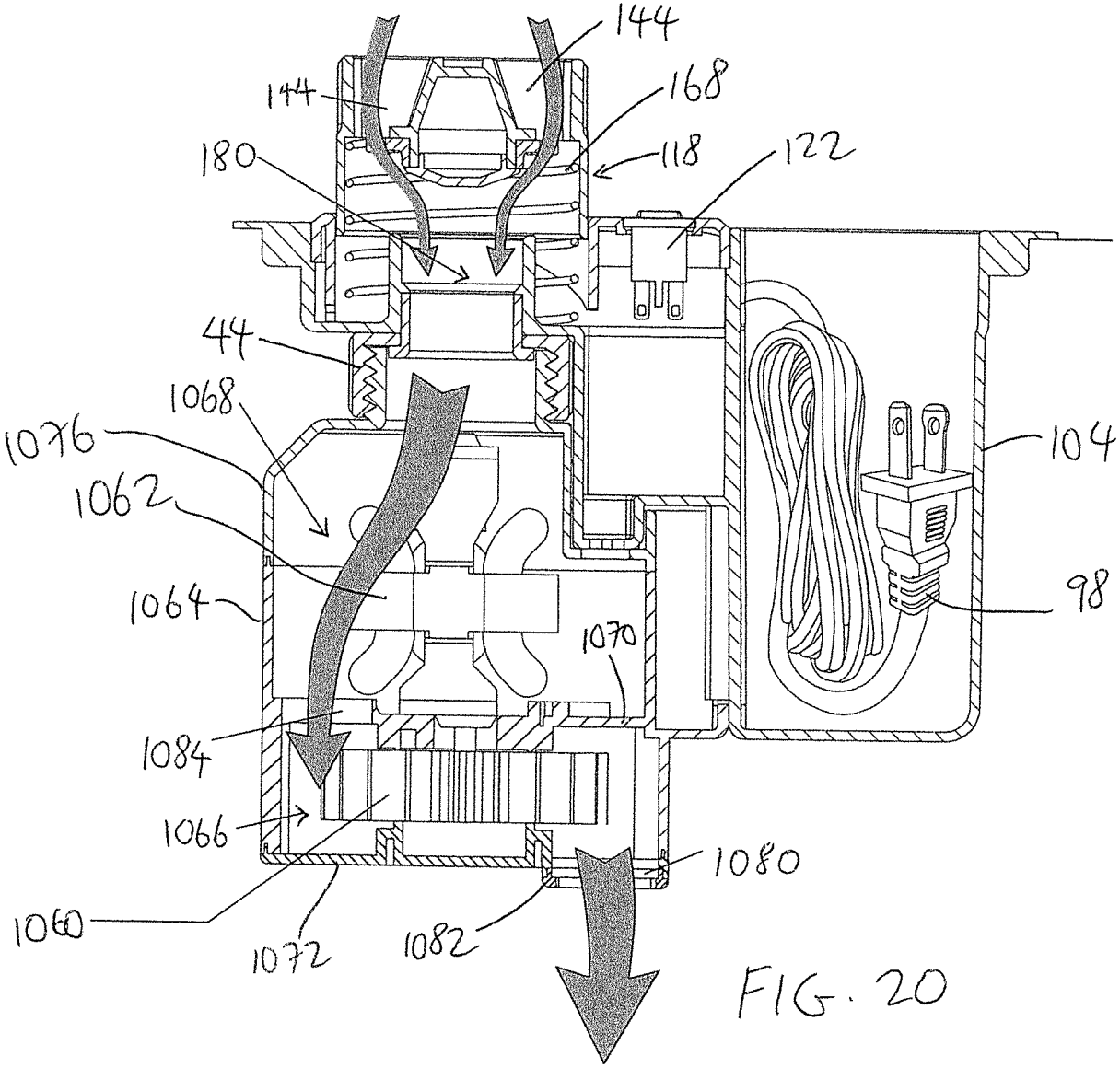
FIG. 20 is a cross-sectional view of the pump assembly of FIGS. 18-19 showing the intake of air into the mattress.

As shown in FIG. 20, when the inflatable mattress 24 is to be inflated, the user opens the knob 118 in the manner described above, and then presses the control button 122 towards position 212 turn on the motor 1062 to rotate the blower 1060 in a first direction. As explained above, air is then delivered from the external environment through the air passages 144 into the air channel 180 and then into the tube 86, where the air enters the motor compartment 1068. From there, the air is directed through the opening 1084 in the platform 1070 into the blower compartment 1066, where the blower 1060 will direct the air towards and through the inlet/outlet opening 1080 into the mattress 24. When the mattress 24 has been inflated, the user turns off the motor 1062 by pressing the control button 122 again to the position 210, and then pushes the intake knob 118 down to seal the air channel 180.

Figure 21:
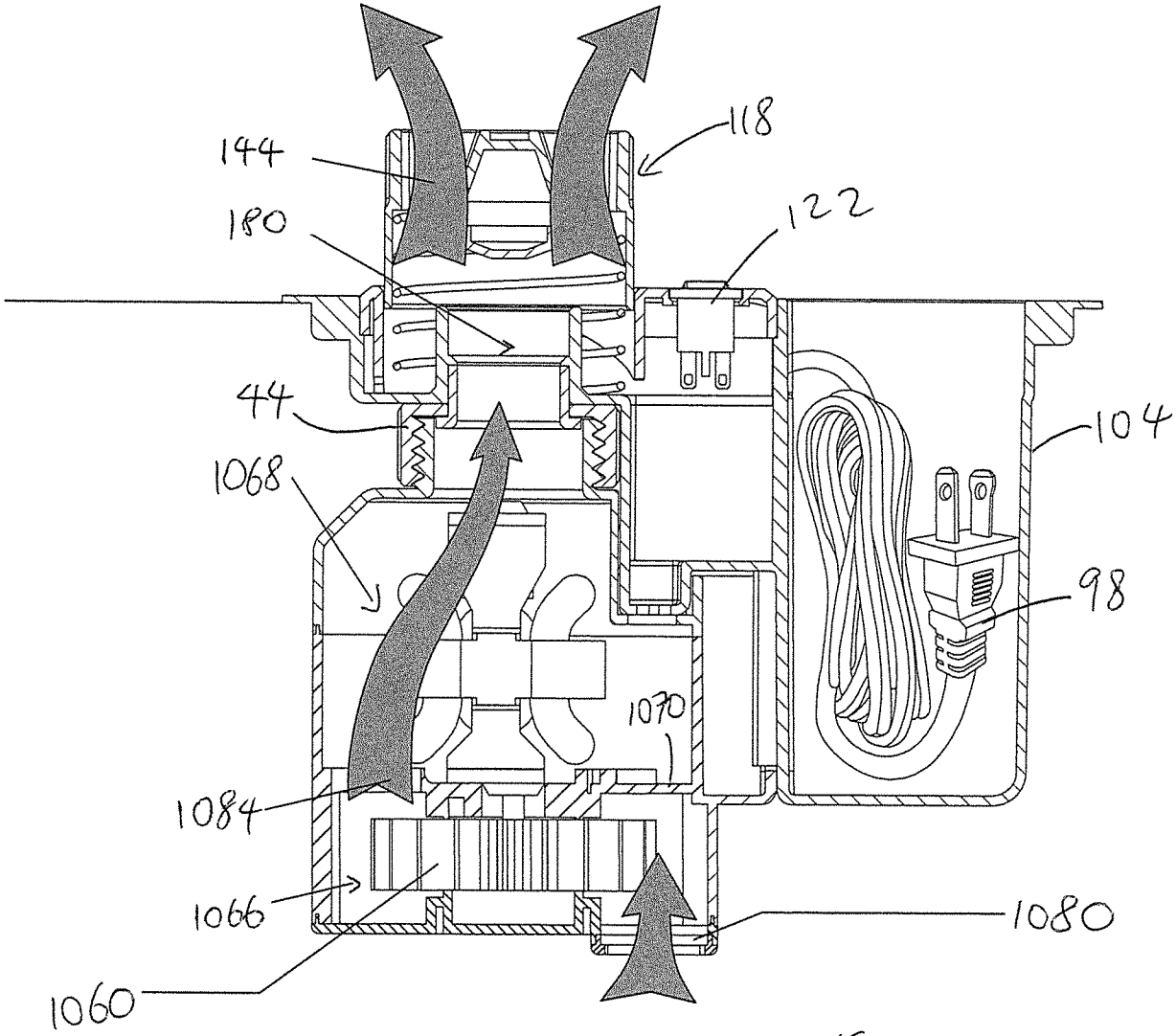
FIG. 21 is a cross-sectional view of the pump assembly of FIGS. 18-19 showing air being pumped out of the mattress.
Figure 22:
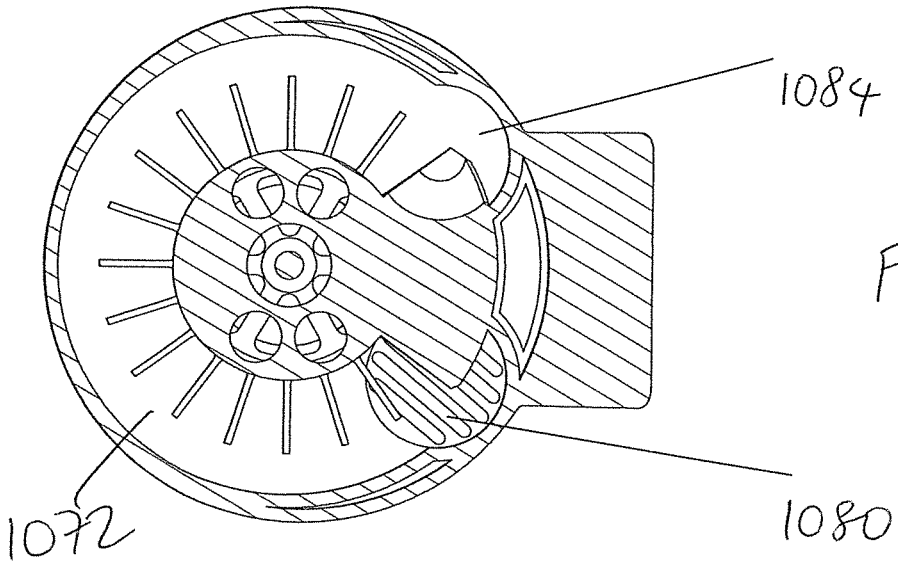
FIG. 22 is a bottom view of the pump unit of the pump assembly of FIGS. 18-19.

As shown in FIG. 21, when the inflatable mattress 24 is to be deflated, the user opens the knob 118 again in the manner described above, and then presses the control button 122 to the position 214 to turn on the motor 1062 to rotate the blower 1060 in a second direction. Rotation of the blower 1060 in the second direction will draw air from the mattress 24 through the inlet/outlet opening 1080 into the blower compartment 1066, and then the air is directed through the opening 1084 in the platform 1070 into the motor compartment 1068. From there, the air is directed towards the tube 86 into the air channel 180 and then through the air passages 144 into the external environment.

Fifth Alternative Embodiment

Figure 23:
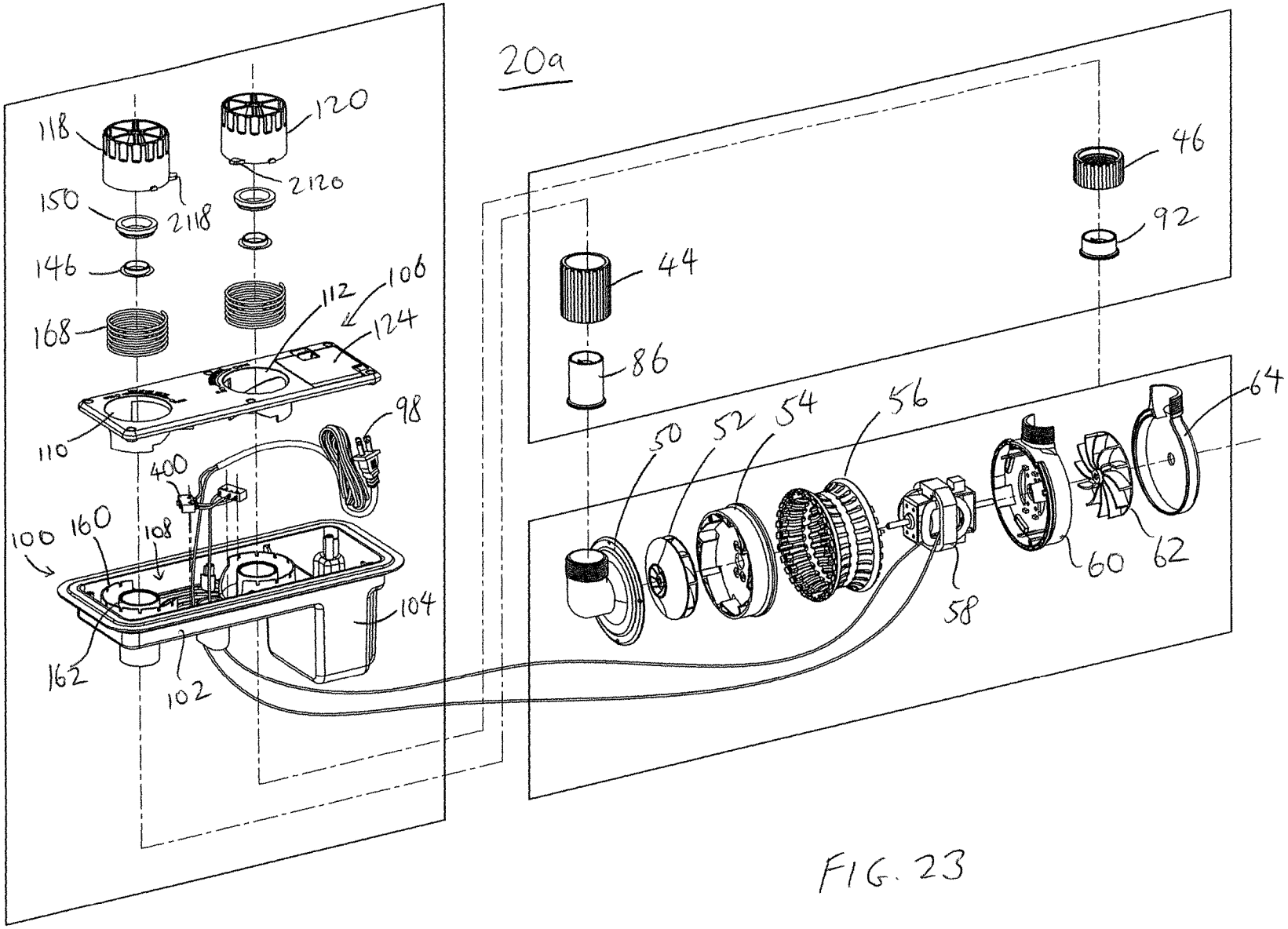
FIG. 23 is an exploded perspective view of the pump assembly according to yet another embodiment of the present invention.
Figure 24:
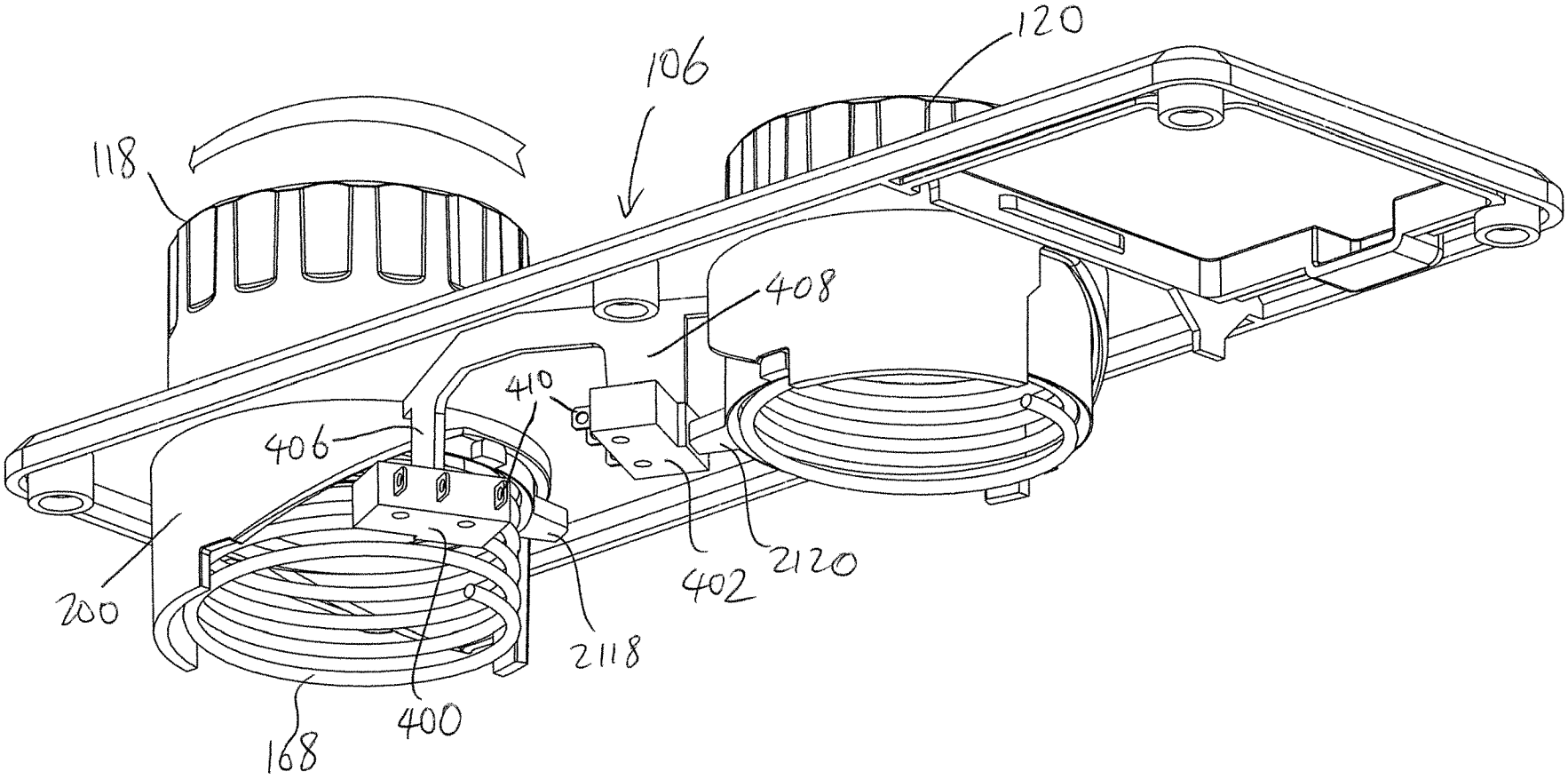
FIG. 24 is a bottom perspective view of the cover of the control housing assembly of the pump assembly of FIG. 23.
Figure 25:
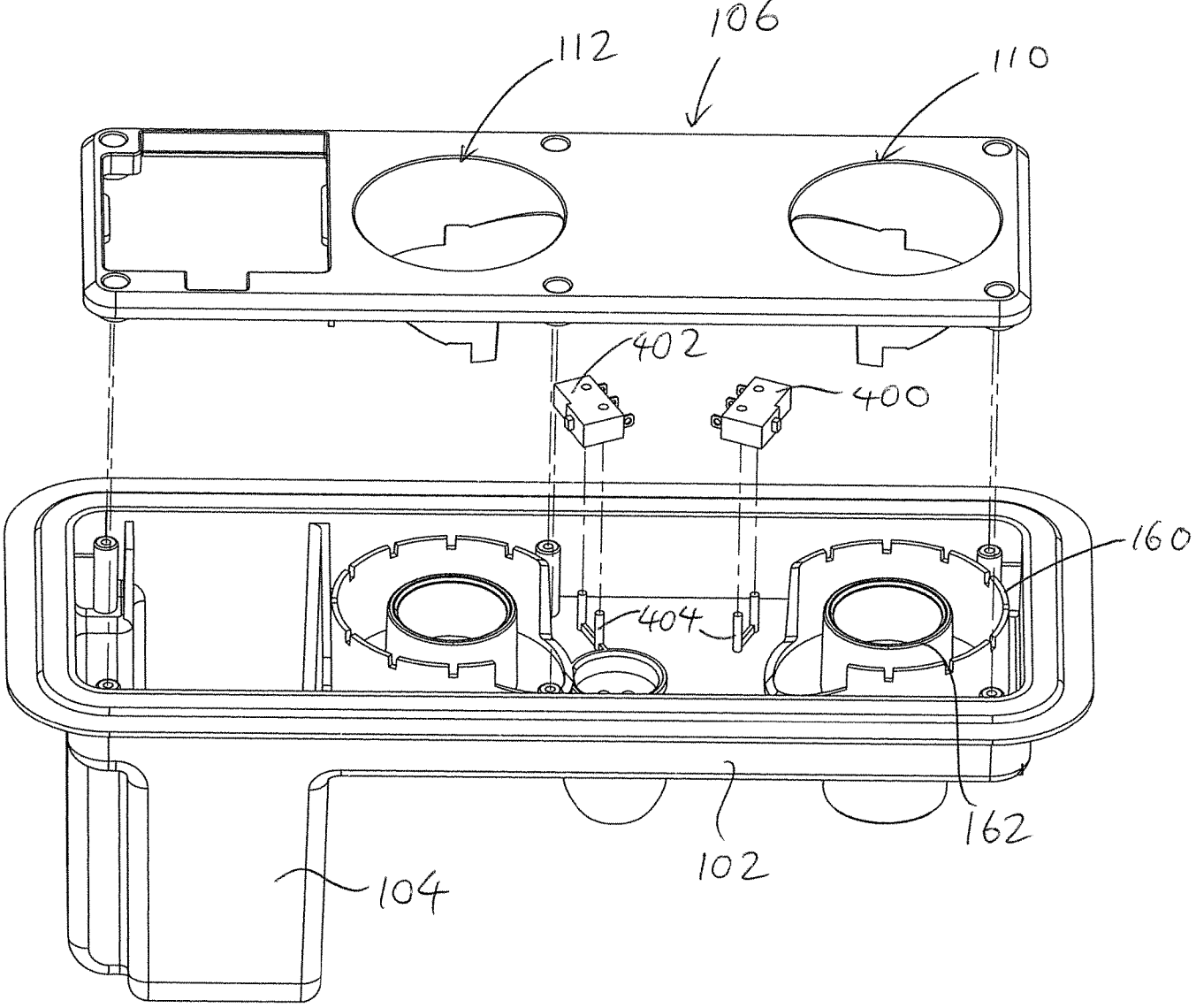
FIG. 25 is an exploded top perspective view of the control housing assembly of the pump assembly of FIG. 23.

FIGS. 23-25 illustrate another embodiment of the pump assembly 20*a* present invention. The embodiment in FIG. 23 is similar to the other embodiments, except that the control housing assembly 40 has been modified to eliminate the control button 122, and the motor 58 can be turned on and off by turning the knobs 118 and 120. By eliminating the control button 122, this embodiment provides a more convenient operation by the user, who only needs to turn the knobs 118 and 120 to control the inflation and deflation operations of the pump assembly 20 without the need to press another button. Each knob 118 and 120 also has a corresponding knob bump 2118 and 2120, respectively, provided at its bottom peripheral edge that functions to contact the corresponding microswitch 400 and 402, respectively.

FIG. 23 is an exploded perspective view of the pump assembly 20*a*. When compared with FIGS. 3A and 3B, it can be seen that the double blower assembly 42 is the same as for FIGS. 3A-3B, so the same numeral designations are used in both embodiments. In addition, most of the components of the control housing assembly 40 are also the same in both embodiments, so the same numeral designations are also used in both embodiments. Similar but different components are designated with the same numeral but with an "a" added to the component in the embodiment of FIGS. 23-25.

Figure 26A:
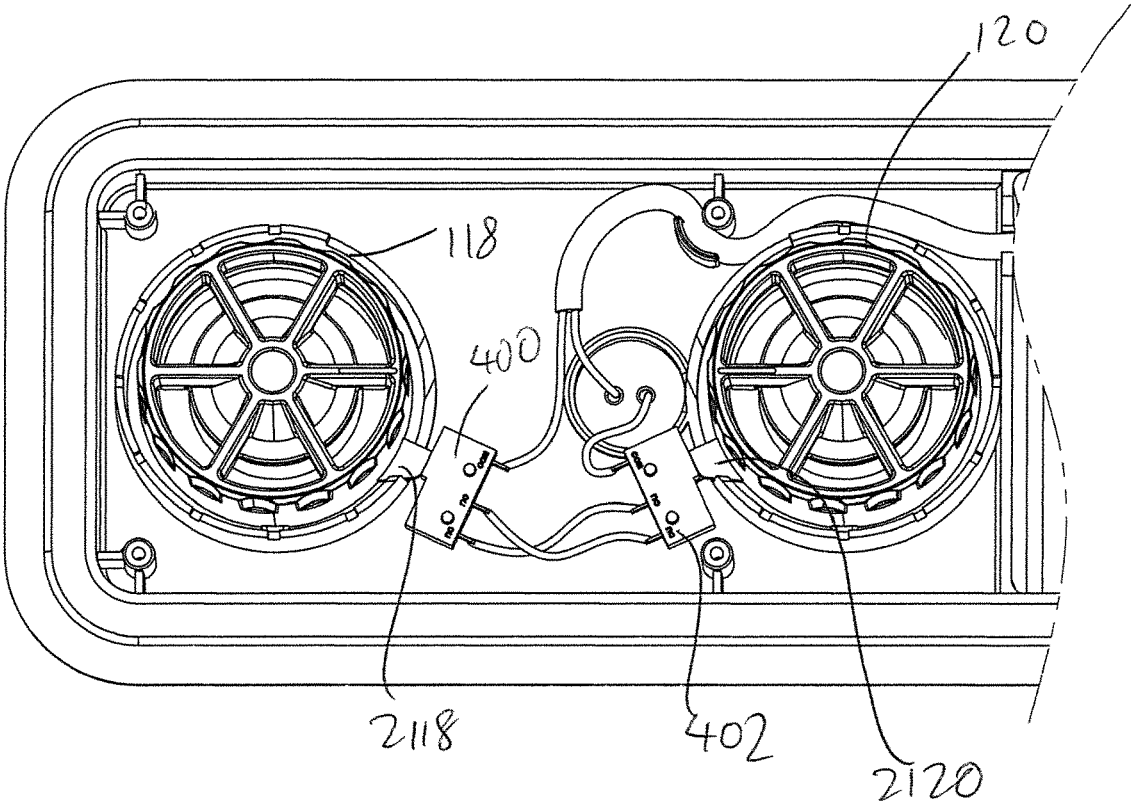
FIGS. 26A, 27A, 28A and 29A illustrate the different positions of the knobs during the four different operation states.

Referring now to FIGS. 24-25, two microswitches 400 and 402 are secured to the base of the rectangular section 102 via positioning columns 404 that extend through the body of the microswitches 400 and 402. Microswitch supports 406 and 408 extend from the bottom surface of the cover 106 to connect and support the microswitches 400 and 402, respectively. Referring also to FIGS. 24 and 26A, the microswitches 400 and 402 have contacts 410, with electrical wires connected to these contacts to create the desired circuits. As shown in FIGS. 23 and 26A, the wires connect the microswitches 400 and 402 to each other, to the power plug 98, and to the motor 58. The microswitches 400 and 402 operate in conjunction with the knobs 118 and 120 to simultaneously control the operation of the pump assembly, and to turn the motor 58 on and off.

FIGS. 26A, 27A, 28A and 29A illustrate the different positions of the knobs 118 and 120 during the four different operation states, and FIGS. 26B, 27B, 28B and 29B illustrate the four corresponding electrical connections for the four respective states.

Figure 26B:
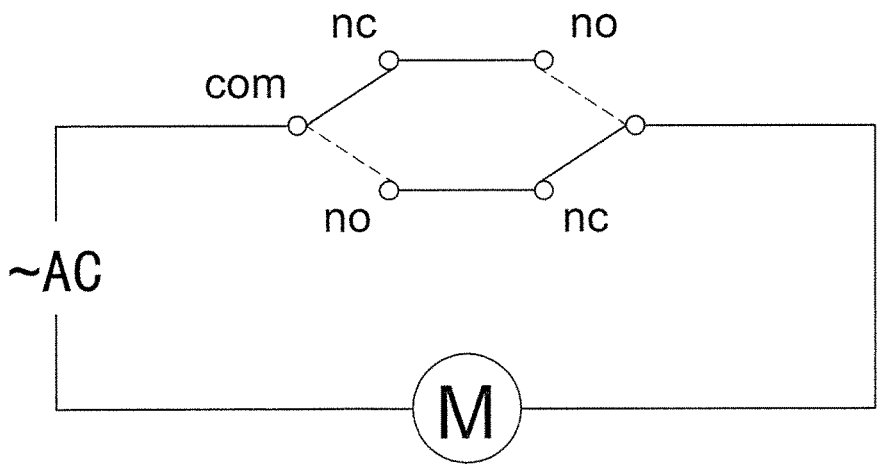
FIGS. 26B, 27B, 28B and 29B illustrate the four corresponding electrical connections for the four respective states in FIGS. 26A, 27A, 28A and 29A.

FIGS. 26A and 26B illustrate the sealed or non-use state. In this state, both knobs 118 and 120 are pressed down to seal the respective air channels 180 and 194. The bumps 2118 and 2120 contact the microswitches 400 and 402, respectively, and the two microswitches 400 and 402 are normally open (NO) (see FIG. 26B). Since the wiring between the two microswitches 400 and 402 is cross-connected (i.e., a normally opened contact is connected to a normally closed contact), the circuit is dis-connected, and the motor 58 does not turn on.

Figure 27A:
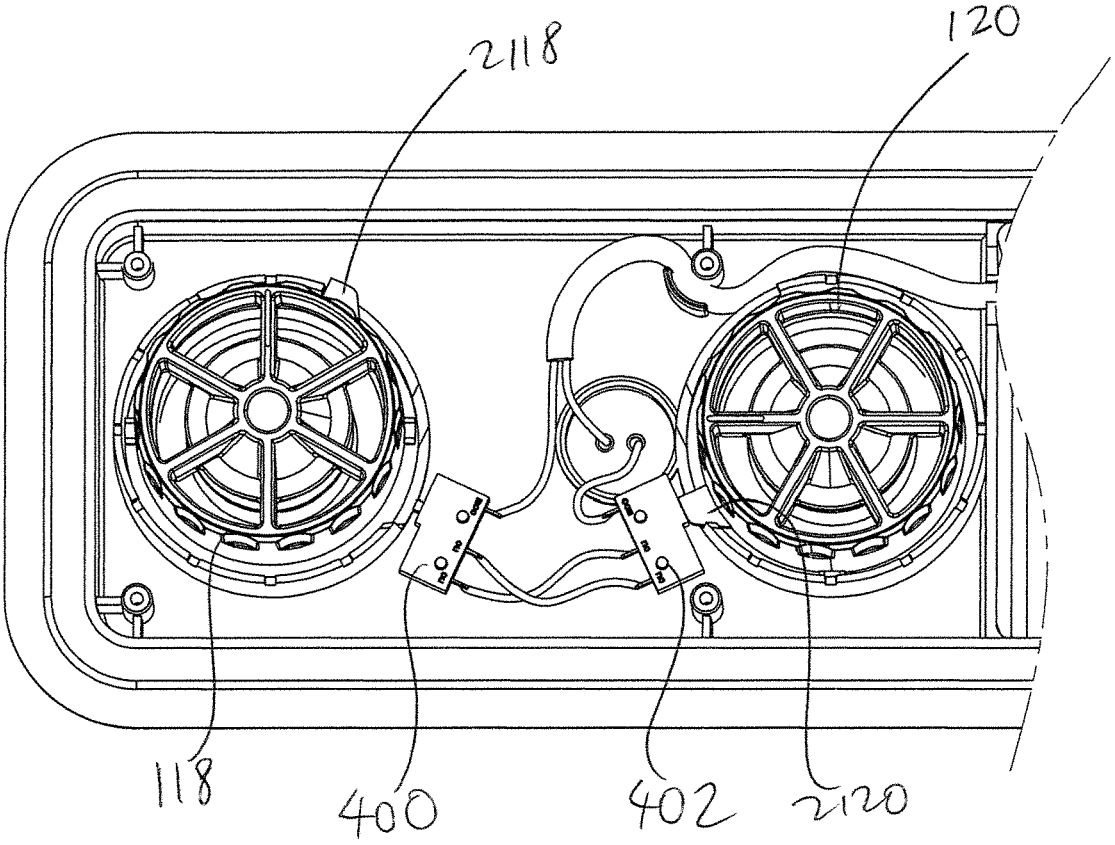
Figure 27B:
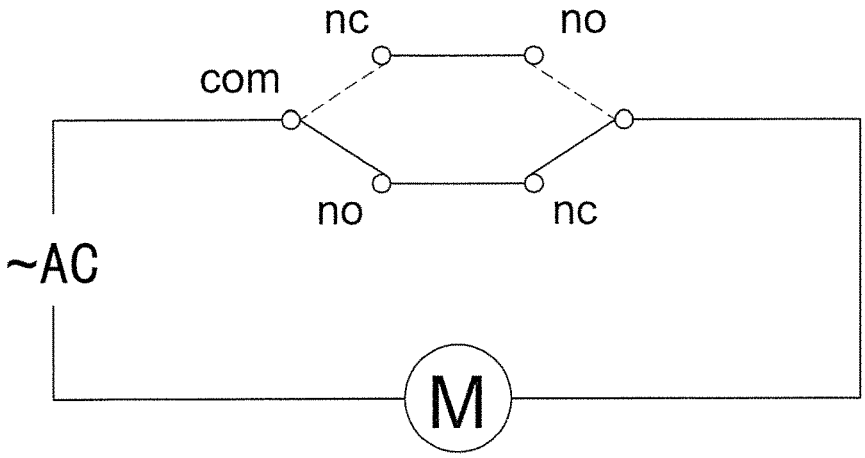

FIGS. 27A and 27B illustrate the inflation state. In this state, the knob 118 is raised and turned to open the air channel 180, while the knob 120 is pressed down to seal the air channel 194. The bump 2118 does not contact the microswitch 400 and the bump 2120 contacts the microswitch 402. The microswitch 400 is normally closed (NC) and the microswitch 402 is normally open (NO), so the circuit is connected and the motor 58 will turn on.

Figure 28A:
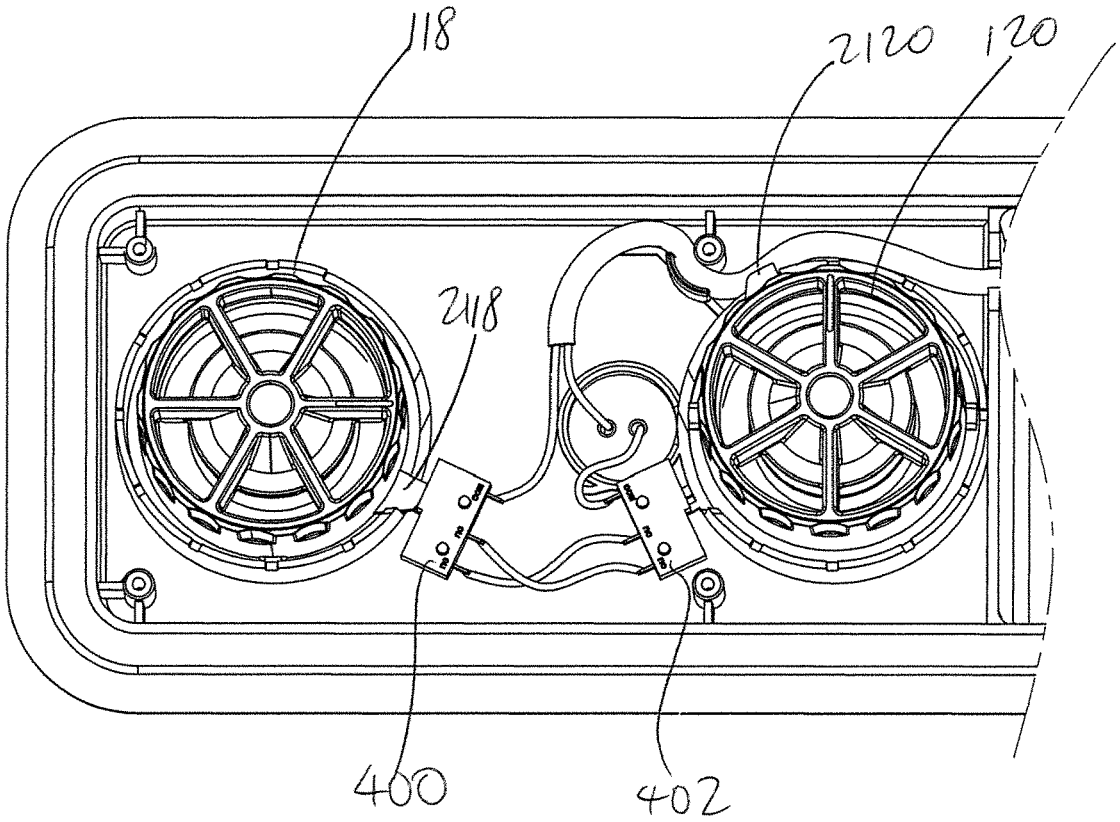
Figure 28B:
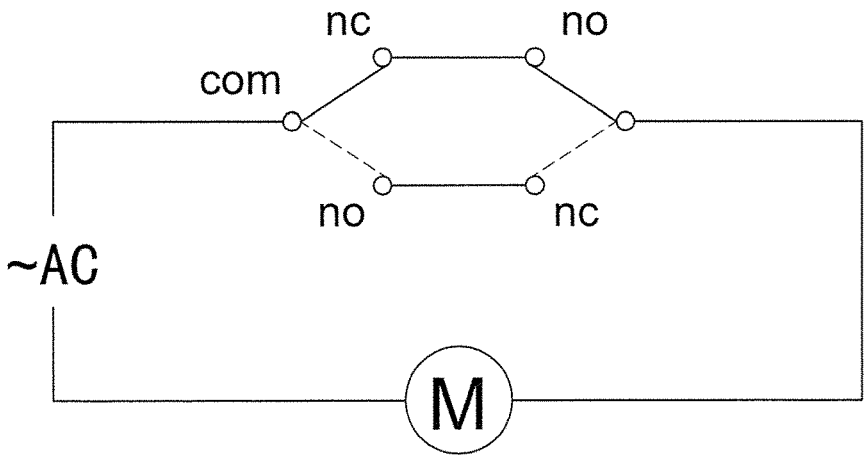

FIGS. 28A and 28B illustrate the deflation state where the motor 58 is actuated to actively inflate the air mattress. In this state, the knob 120 is raised and turned to open the air channel 194, while the knob 118 is pressed down to seal the air channel 180. The bump 2120 does not contact the microswitch 402 and the bump 2118 contacts the microswitch 400. The microswitch 400 is normally open (NO) and the microswitch 402 normally closed (NC), so the circuit is connected and the motor 58 will turn on.

Figure 29A:
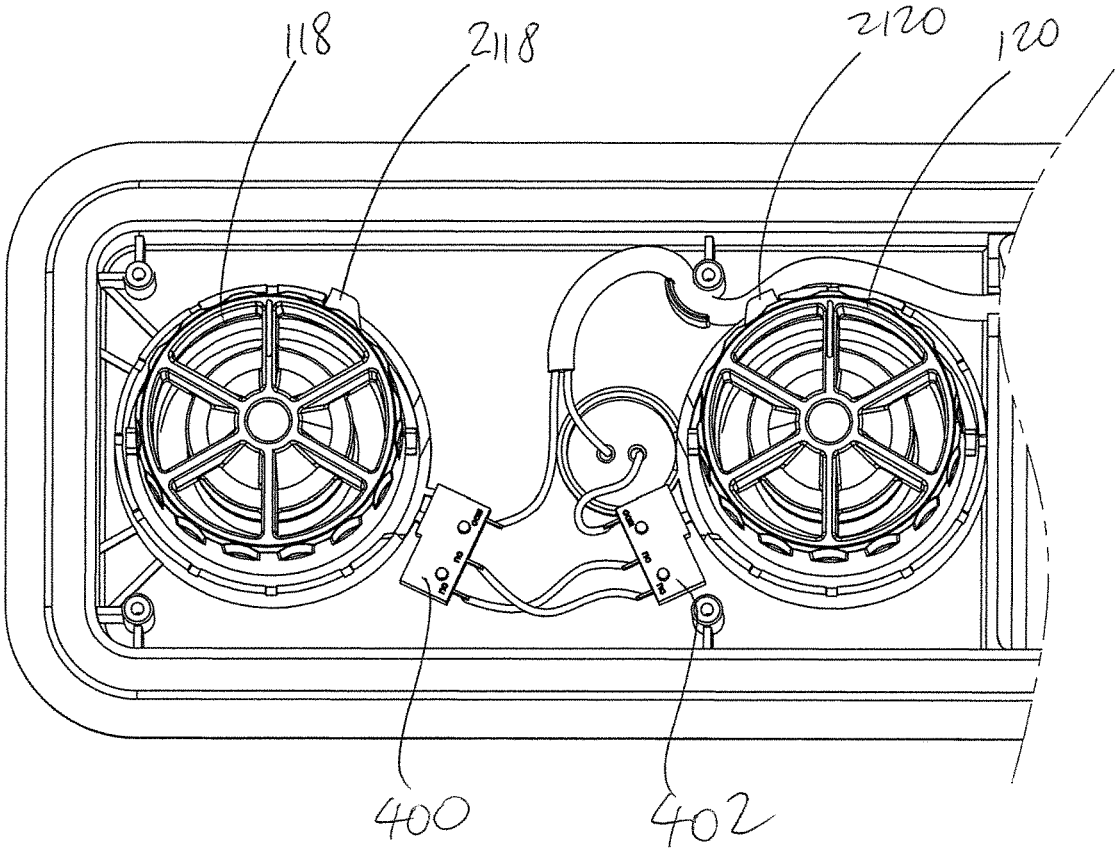
Figure 29B:
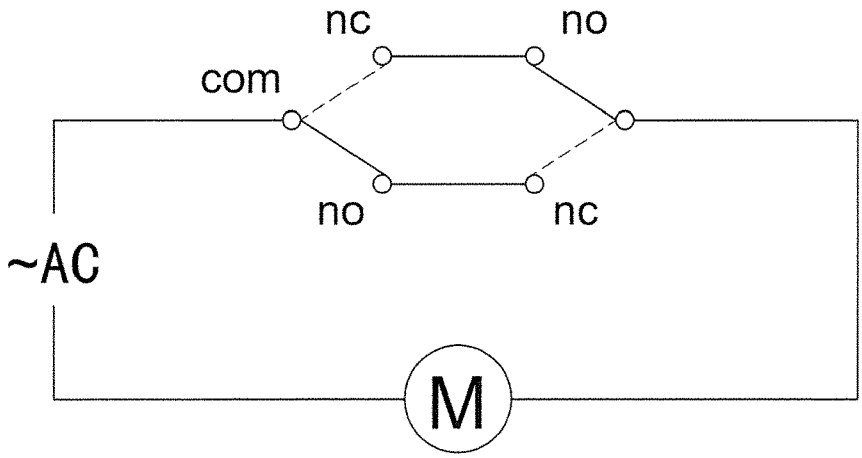

FIGS. 29A and 29B illustrate the automatic deflation state where the motor 58 is not used to deflate the air mattress. In this state, both knobs 118 and 120 are raised and turned to open both air channels 180 and 194. The bumps 2118 and 2120 do not contact the microswitches 400 and 402, respectively, and the two microswitches 400 and 402 are opened (see FIG. 26B). Since the wiring between the two microswitches 400 and 402 is cross-connected (i.e., a normally opened contact is connected to a normally closed contact), the circuit is dis-connected, and the motor 58 does not work. The micrcoswitches 400 and 402 are both normally closed (NC), so the circuit is disconnected.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. An inflatable product, comprising:

a chamber having an air inlet and an air outlet;

a pump assembly having a pump unit positioned inside the chamber for inflating and deflating the chamber, the pump unit having at least one motor that is operatively coupled to a first blower and a second blower, wherein the first blower is fluidly coupled to the air inlet and the second blower is fluidly coupled to the air outlet;

the pump assembly further including an intake knob that controls the air inlet and an exhaust knob that controls the air outlet, wherein turning the intake knob will control both the at least one motor and the opening of the air inlet, and turning the exhaust knob will control both the at least one motor and the opening of the air outlet; and wherein the chamber is inflated by turning the intake knob to actuate the at least one motor and facilitate intake of air through the air inlet to the first blower and then into the chamber, and the chamber is deflated by turning the exhaust knob to actuate the at least one motor and facilitate drawing air from the chamber to the second blower and then out of the chamber through the air outlet.

2. The product of claim 1, wherein the air outlet is sealed when the chamber is inflated.

3. The product of claim 1, wherein the air inlet is sealed when the chamber is deflated.

4. The product of claim 1, wherein the first blower is oriented ninety degrees from the second blower along a rotational axis for the first blower and the second blower.

5. The product of claim 1, wherein the pump unit has a housing that defines an inlet chamber that houses the first blower and an outlet chamber that houses the second blower, and with the inlet chamber having an inlet opening and the outlet chamber having an outlet opening, wherein the inlet opening is oriented ninety degrees apart from the outlet opening along a rotational central axis for the inlet opening and then a central axis for the outlet opening.

6. The product of claim 1, further including a tube which connects the air inlet with the first blower.

7. The product of claim 1, further including a tube which connects the air outlet with the second blower.

8. The product of claim 7, wherein the tube is a first tube, and further including a second tube which connects the air outlet with the second blower.

9. The product of claim 1, wherein when both the intake knob and the exhaust knob are both turned, the at least one motor is not turned on, and air can be discharged from the chamber via the air outlet.

10. The product of claim 1, wherein a first microswitch is operatively coupled to the intake knob.

11. The product of claim 10, wherein a second microswitch is operatively coupled to the exhaust knob.

* * * * *